US012716619B2

(12) United States Patent
Johansson et al.

(10) Patent No.: US 12,716,619 B2
(45) Date of Patent: Aug. 25, 2026

(54) COLLECTOR AND USE THEREOF

(71) Applicant: MuoviTech AB, Brämhult (SE)

(72) Inventors: Kim Johansson, Brämhult (SE); Kari Ojala, Brämhult (SE); Adib Kalantar, Brämhult (SE)

(73) Assignee: MuoviTech AB, Brämhult (SE)

( * ) Notice: Subject to any disclaimer, the term of this patent is extended or adjusted under 35 U.S.C. 154(b) by 156 days.

(21) Appl. No.: 18/724,132

(22) PCT Filed: Dec. 23, 2022

(86) PCT No.: PCT/EP2022/087730
§ 371 (c)(1),
(2) Date: Jun. 25, 2024

(87) PCT Pub. No.: WO2023/126348
PCT Pub. Date: Jul. 6, 2023

(65) Prior Publication Data

US 2025/0067480 A1 Feb. 27, 2025

(30) Foreign Application Priority Data

Dec. 28, 2021 (EP) ..... 21217903
Jul. 20, 2022 (EP) ..... 22186021

(51) Int. Cl.
*F24T 10/15* (2018.01)
*F24T 10/00* (2018.01)

(52) U.S. Cl.
CPC ..... *F24T 10/15* (2018.05); *F24T 2010/53* (2018.05)

(58) Field of Classification Search
CPC . F24T 10/13; F24T 10/15; F24T 10/17; F24T 2010/05; Y02E 10/10
See application file for complete search history.

(56) References Cited

U.S. PATENT DOCUMENTS 5,630,447 A * 5/1997 Jensen ..... F24T 10/13 138/117
9,816,023 B2 11/2017 Lawless et al.
2008/0289795 A1* 11/2008 Hardin ..... F24T 10/15 165/45

(Continued)

FOREIGN PATENT DOCUMENTS

CH 649623 A5 5/1985
DE 102007024561 A1 11/2008

(Continued)

*Primary Examiner* — Eric S Ruppert
*Assistant Examiner* — Hans R Weiland
(74) *Attorney, Agent, or Firm* — Flaster Greenberg PC

(57) ABSTRACT

A polymer geothermal collector (1) for extracting geothermal energy from a well (W). The polymer geothermal collector (1) being configured to be placed in the well (W) for enabling circulation of a fluid in the polymer geothermal collector (1) for performing heat exchange between the fluid in the polymer geothermal collector (1) and the well (W). A first and second portion (1',1") of the polymer geothermal collector (1) each have a curved outer surface (OS) configured to face an inner surface (IS) of the well (W), and the polymer geothermal collector (1) further comprises a hydrophilic swelling material (14) disposed between the first and second portions (1',1") of the polymer geothermal collector (1).

18 Claims, 11 Drawing Sheets

(56) References Cited

U.S. PATENT DOCUMENTS

| | | | | |
|---|---|---|---|---|
| 2009/0025902 | A1 | 1/2009 | Favier et al. | |
| 2011/0232795 | A1* | 9/2011 | Hardin | F24T 10/15 138/111 |
| 2013/0112368 | A1* | 5/2013 | Koenig | F24T 10/15 165/45 |
| 2020/0132384 | A1 | 4/2020 | De Cunha Maluf | |

FOREIGN PATENT DOCUMENTS

| | | | | |
|---|---|---|---|---|
| DE | 102009040476 | A1 | 3/2011 | |
| DE | 102009031364 | A1 | 4/2011 | |
| EP | 0582118 | A1 * | 2/1994 | E02D 27/12 |
| EP | 3026367 | A2 | 6/2016 | |
| EP | 3847408 | B1 | 1/2022 | |
| KR | 20120017581 | A | 2/2012 | |
| KR | 20150000062 | A | 1/2015 | |
| WO | 2009074287 | A1 | 6/2009 | |
| WO | 2011083899 | A1 | 7/2011 | |
| WO | 2020006620 | A1 | 1/2020 | |
| WO | 2021094644 | A1 | 5/2021 | |

* cited by examiner

COLLECTOR AND USE THEREOF

CROSS-REFERENCE TO RELATED APPLICATIONS

This application is the 371 National Stage of International Application No. PCT/EP2022/087730, filed Dec. 23, 2022, which claims the benefit of European Patent Application No. 21217903.0, filed Dec. 28, 2021, and claims the benefit of European Patent Application No. 22186021.6, filed Jul. 20, 2022, the disclosures of which are incorporated herein by reference in their entireties.

TECHNICAL FIELD

The present application relates to pipe collectors for geothermal heat exchange, geothermal pipe collector systems and methods for installing geothermal pipe collectors and geothermal pipe collector systems.

BACKGROUND OF THE INVENTION

Geothermal energy is energy stored as heat in the ground. This energy may originate from the hot core of the earth or may be heat generated by the earth surface being exposed to infrared radiation from the sun. Most geothermal installations today use the second category of geothermal energy, i.e. solar energy stored as heat in e.g. water, ground or bedrock.

In a geothermal energy system using circulating fluid, the heat is extracted from the ground (e.g. water or bedrock) using a geothermal pipe collector. In the geothermal pipe collector, the fluid, known as heat transfer medium or heat transfer liquid is circulated such that fluid heated by the geothermal energy is extracted in one end of the geothermal pipe collector, the cooled fluid is then returned in the other end of the geothermal pipe collector such that a closed system is created.

Examples of geothermal energy systems are ground surface heat systems, sea heat systems and borehole heat systems. In ground surface heat systems, a several hundred meters long geothermal pipe collector is buried in the ground at a frost proof depth. In a sea heat system, a similar pipe collector is placed in the sea water and/or on/in the seabed.

In a borehole heat system, a geothermal pipe collector having two fluid conduits are placed in the bore hole, one for transporting fluid upwards and one for transporting it downwards. Temperature differences may hereby be used for heating or cooling e.g., a building. There is substantial loss of energy in the pipes used in state-of-the-art system, and therefore there is a general need for improving the energy efficiency of geothermal pipe collectors for increasing the efficiency in the heat pump system.

In many applications, polymer pipe collectors are used. However, polymer material are generally relatively good thermal insulators, i.e., have relatively low thermal conductivity in comparison with for example metals. This is a drawback when polymer materials are used in heat exchange applications. For the purpose of decreasing the thermal resistance in the pipe collector, the wall thickness of the pipe collector may be decreased. However, decreasing the wall thickness affects the mechanical properties of the collector, which may be a disadvantage for fulfilling the requirements of collector standards and for the handling of the collector.

SUMMARY OF THE INVENTION

In view of the above-mentioned and other drawbacks of the prior art, the object of the present inventive concept is to provide a geothermal system that has an improved energy efficiency.

A polymer geothermal collector for extracting geothermal energy from a well is provided. The polymer geothermal collector is configured to be placed in the well for enabling circulation of a fluid in the polymer geothermal collector, when placed in the well, for performing heat exchange between the fluid in the polymer geothermal collector and the well. The geothermal collector comprises a first portion for transporting the fluid into the well and a second portion for transporting the fluid out from the well. The first and second portions of the polymer geothermal collector each have a curved outer surface configured to face an inner surface of the well. The polymer geothermal collector further comprises a hydrophilic swelling material disposed between the first and second portions of the polymer geothermal collector. The hydrophilic swelling material is configured to expand when exposed to water and to engage and exert force against the first and second portions of the polymer geothermal collector to increase a distance between the first and second portions of the polymer geothermal collector to thereby decrease a distance between at least one of the curved outer surfaces and the inner surface of the well. As the distance between the curved outer surfaces and the inner surface of the well is decreased, more contact and less thermal resistance is created between the polymer geothermal collector and the well, which increases the heat exchange between the well and the fluid circulating in the polymer geothermal collector.

According to one embodiment, the first and second portions of the polymer geothermal collector each have a non-circular cross-section. The non-circular cross-sections have a first cross-sectional distance having a first length and a second cross-sectional distance having a second length, in a plane perpendicular to the length extension of the polymer geothermal collector. The second length is at least 1,2 times the first length, or the second length is at least 1,3 times the first length, or the second length is at least 1,4 times the first length. Having a non-circular cross-section enables an increase/optimization of the cross-sectional areas relative to the mechanical strength of the first and second portions of the polymer geothermal collector in which the fluid is flowing, which may reduce the pressure drop in polymer geothermal collector reducing the force required for circulating the fluid.

At least one of the first and second portions of the polymer geothermal collector may comprise at least one protruding support element for assisting in directing the force exerted by the hydrophilic swelling material as the hydrophilic swelling material expands, such that a major portion of the expansion can occur in the desired direction for pushing apart the first and second portions of the polymer geothermal collector.

According to one embodiment, the first portion of the polymer geothermal collector comprises two protruding support elements for assisting in directing the force exerted by the hydrophilic swelling material towards the second portion as it expands. The second portion of the polymer geothermal collector may also comprise two protruding support elements. In embodiments in which both the first and second portions of the polymer geothermal collector comprises protruding support elements, the protruding support elements of the first portion of the polymer geothermal collector may be configured to protrude towards the two protruding support elements of the second portion of the polymer geothermal collector, such that the hydrophilic swelling material can be at least partially confined by the protruding support elements of the first and second portions of the polymer geothermal collector, or completely confined in its non-expanded state.

The two protruding support elements of the first portion of the polymer geothermal collector may be parallel to each other, and/or parallel to the two protruding support elements of the second portion of the polymer geothermal collector.

According to one embodiment, at least one of the protruding support elements protrudes a length from the curved outer surfaces of the first or second portions of the polymer geothermal collector exceeding the average wall thickness of the wall first or second portions of the polymer geothermal collector.

The hydrophilic swelling material in any of the embodiments herein may be a hydrophilic thermoplastic elastomer (TPE). The hydrophilic swelling material may be a hydrophilic swelling material having an expanded volume exceeding two times a non-expanded volume, or having an expanded volume exceeding four times a non-expanded volume.

According to one embodiment, the hydrophilic swelling material at least partially encloses a non-expanding core and/or is at least partially enclosed by a non-expanding material. The non-expanding material may assist in directing the expanding force exerted by the hydrophilic swelling material and may complement and/or replace the protruding support elements.

According to one embodiment, the hydrophilic swelling material comprises at least one concave curved surface which may assist in directing the expanding force exerted by the hydrophilic swelling material and may complement and/or replace the non-expanding material and/or the protruding support elements.

According to one embodiment, the non-circular cross-sections of the first and second portions of the polymer geothermal collector are elliptical.

According to one embodiment, the hydrophilic swelling material is fixated to at least one of the first and second portions of the polymer geothermal collector.

According to one embodiment, the hydrophilic swelling material is fixated to the first and second portions of the polymer geothermal collector, such that the first and second portions of the polymer geothermal collector are fixated to each other by their respective fixations to the hydrophilic swelling material.

According to one embodiment, the polymer geothermal collector has a total length of more than 800 m, such that the polymer geothermal collector is adapted for a well having a depth of more than 400 m. In the alternative, the polymer geothermal collector may have a total length of more than 1000 m, such that the polymer geothermal collector is adapted for a well having a depth of more than 500 m.

According to one embodiment, the first portion of the polymer geothermal collector and the second portion of the polymer geothermal collector have uniform cross sections.

A method of installing a polymer geothermal collector according to any one of the embodiments herein in a well is further provided, for enabling circulation of a fluid in the polymer geothermal collector when placed in the well, for performing heat exchange between the fluid in the polymer geothermal collector and the well. The geothermal collector comprises a first portion for transporting the fluid into the well and a second portion for transporting the fluid out from the well. The method comprising feeding the first portion, the second portion and a hydrophilic swelling material into the well, such that the hydrophilic swelling material is disposed between the first and second portions. The steps of feeding the first portion, the second portion, and the hydrophilic swelling material into the well may be performed simultaneously.

According to one embodiment, the steps of feeding the first portion, the second portion, and the hydrophilic swelling material into the well are performed using a motorized feeding machine comprising at least one pulley configured to engage and feed the first portion and at least one second pulley configured to engage and feed the second portion.

A geothermal pipe collector for transporting a fluid for heat exchange with the ground surrounding a borehole is further provided. The geothermal pipe collector comprises an outer pipe comprising a fiber reinforced thermoset polymer material, and an inner pipe made from a material comprising a second polymer material, different from the fiber reinforced thermoset polymer material. The inner pipe is co-axially arranged in the outer pipe, such that a central longitudinal lumen for transporting the fluid in a first direction is formed in the inner pipe, and an intermediate longitudinal lumen for transporting the fluid in a second direction is formed between the inner and outer pipes. The average wall thickness of the inner pipe is more than 1,1 times the average wall thickness of the outer pipe. The outer pipe is adapted to exchange heat with the ground surrounding the borehole, when in use.

Having an outer pipe made from a fiber reinforced thermoset polymer material enables the outer pipe to be made relatively thin, which reduces the thermal resistance of the outer pipe which increases the heat exchange between the bore hole and the fluid on the inside of the wall of the outer pipe. Also, having an inner pipe with an average wall thickness being thicker than the average wall thickness of the outer pipe increases the thermal resistance of the inner pipe which reduces the heat transfer between the fluid transported in the inner pipe and the fluid transported between the outer and inner pipes, which increases the heat exchange efficiency of the geothermal pipe collector.

According to one embodiment, the fiber reinforced thermoset polymer material comprises an epoxy material. Epoxy material is relatively durable and have a relatively low thermal resistance. Epoxy material also maintains its mechanical properties also at relatively high temperatures for geothermal applications, such as temperatures exceeding 80° C.

According to one embodiment, the fiber reinforced thermoset polymer material comprises a polyester resin. Polyester resin is relatively durable and have a relatively low thermal resistance.

According to one embodiment, the fiber reinforced thermoset polymer material comprises glass fibers. Glass fiber enforcement increases the mechanical properties, tensile strength, stiffness and durability of the thermoset polymer material and enables a reduction of the wall thickness and thereby the thermal resistance.

According to one embodiment, the fiber reinforced thermoset polymer material comprises carbon fibers. Carbon fiber enforcement increases the mechanical properties, tensile strength, stiffness and durability of the thermoset polymer material and further reduces the wall thickness and thermal resistance.

According to one embodiment, the second polymer material is more elastic than the fiber reinforced thermoset polymer material.

According to one embodiment, the second polymer material comprises a PVC-based material. PVC-based material has relatively low thermal conductivity, i.e. high thermal resistance compared to PE-based materials.

According to one embodiment, the second polymer material comprises a natural rubber-based material, and/or a synthetic rubber-based material. Rubber-based materials have the advantage that they maintain their mechanical properties also when exposed to temperatures exceeding 80° C., which enables the use of the geothermal pipe collector also in applications in which fluid temperatures above 80° C. is desired.

According to one embodiment, the outer pipe has lower thermal resistance than the inner pipe, which increases the heat exchange between the bore hole and the fluid in the geothermal pipe collector as well as decreases the heat exchange between the fluid in the inner and the fluid between the inner and outer pipe.

According to one embodiment, the inner pipe comprises more gas measured in volume percentage than the material of the outer pipe. Gas is generally a poor thermal conductor, which means that the introduction of gas in the material of the inner pipe increases the thermal resistance of the inner pipe which reduces the heat exchange between the fluid in the inner and the fluid between the inner and outer pipe.

According to one embodiment, the material of the inner pipe comprises a plurality of volumes of gas enclosed by an enclosing material, which in turn is enclosed by the second polymer material, for increasing the thermal resistance of the second polymer material. The enclosing material is harder than the second polymer material. Having the gas being enclosed by a material which is harder than the second polymer material enables the plurality of volumes of gas to be mixed into the second polymer material, such that the plurality of volumes of gas can be evenly distributed in the second polymer material which optimizes the increase of the thermal resistance of the second polymer material. According to one embodiment, the material which is harder than the second polymer material is glass.

According to one embodiment, the plurality of volumes of gas enclosed by an enclosing material makes up at least 3 volume percent of the material of the inner pipe.

According to one embodiment, the plurality of volumes of gas enclosed by an enclosing material makes up at least 5 volume percent of the material of the inner pipe.

According to one embodiment, the plurality of volumes of gas enclosed by an enclosing material makes up at least 10 volume percent of the material of the inner pipe.

According to one embodiment, the inner pipe has a helical groove on the outer surface, facing the outer pipe, for creating a turbulent flow of the fluid between the inner and outer pipes, for increasing the heat exchange between the fluid and the outer pipe. Making the helical groove on the outer surface of the inner pipe, instead of on the inner surface of the outer pipe is advantageous as the outer pipe then does not need to be made thicker to compensate for the material being removed when making the helical groove, which minimizes the thermal resistance of the outer pipe.

According to one embodiment, the central longitudinal lumen has a cross-sectional area in a plane perpendicular to the length extension of the geothermal pipe collector being larger than a cross-sectional area of the intermediate longitudinal lumen in the same plane. The central longitudinal lumen may have a cross-sectional area in a plane perpendicular to the length extension of the geothermal pipe collector being more than 1,1 times the size of the cross-sectional area of the intermediate longitudinal lumen in the same plane.

A geothermal pipe collector system is further provided. The geothermal pipe collector system comprises the geothermal pipe collector according to any one of the embodiments above, and the fluid for circulation in the geothermal pipe collector. The fluid in the geothermal pipe collector system has a relative density of above 1,10 (relative to the density of water which is 1) for supporting the wall of the outer pipe of the polymer geothermal collector against the pressure from the ground water surrounding the polymer geothermal collector, when the polymer geothermal collector has been installed in the well.

A use of a plurality of geothermal pipe collectors according to any one of the embodiments herein, for forming an assembled coaxial geothermal pipe collector for transporting the fluid is further provided. In one embodiment, the assembled coaxial geothermal pipe collector has a total length of more than 200 meters. In one embodiment, the assembled coaxial geothermal pipe collector has a total length of more than 300 meters. In one embodiment, the assembled coaxial geothermal pipe collector has a total length of more than 400 meters. In one embodiment, the assembled coaxial geothermal pipe collector has a total length of more than 600 meters. In one embodiment, the assembled coaxial geothermal pipe collector has a total length of more than 800 meters.

A method for installing a coaxial geothermal pipe collector comprising a plurality of outer pipes according to any one of the embodiments herein is further provided. The method comprises providing a first outer pipe into a bore hole and bringing a second outer pipe in abutment with the first outer pipe. The method then comprises rotating the second outer pipe relative the first outer pipe, so as to couple said first outer pipe to said second outer pipe by means of two matching threads. The method further comprises providing an inner pipe into the outer pipe placed in the bore hole and providing a second inner pipe in abutment with the first inner pipe into the outer pipe placed in the bore hole. The method then comprises connecting the second inner pipe to the first inner pipe for forming the coaxial collector.

According to one embodiment, the step of rotating the second outer pipe relative the first outer pipe, so as to couple said first outer pipe to said second outer pipe is preceded by the step of applying an adhesive to at least one of the first and second outer pipes, such that the adhesive assists in the coupling of the second outer pipe to the first outer pipe.

According to one embodiment, the step of connecting the second inner pipe to the first inner pipe comprises rotating the second inner pipe relative the first inner pipe, so as to couple the first inner pipe to the second inner pipe by means of two matching threads.

In yet one embodiment of the invention, the inner pipe has thicker wall than the outer pipe, preferably 10% thicker, more preferably 20% thicker and even more preferably 30% thicker. Hereby, the fluid flowing downwards inside the inner pipe may be more isolated from the fluid flowing between the inner and outer pipe so as to obtain a more efficient thermal exchange with the surrounding ground.

According to another aspect of the invention above and other objectives are at least partly achieved by a system for extracting geothermal energy from a well comprises a polymer geothermal collector configured to be placed in the well for enabling circulation of a fluid in the polymer geothermal collector, when placed in the well, for performing heat exchange between the fluid in the polymer geothermal collector and the well. The polymer geothermal collector comprises a first portion for transporting the fluid into the well and a second portion for transporting the fluid out from the well. The first and second portions of the polymer geothermal collector each have a non-circular cross-section, having a first cross-sectional distance having a first length and a second cross-sectional distance having a second length, in a plane perpendicular to the length extension of the polymer geothermal collector. The second length is at least 1,2 times the first length. A wall of each of the first and second portions of the polymer geothermal collector has a wall thickness in the interval 0,02-0,06 times the sum of the first and second lengths. The outer surfaces of the non-circular cross-sections of the first and second portions of the polymer geothermal collector can be placed touching each other and simultaneously touching a circular footprint. The combined cross-sectional area of the first and second portions of the geothermal collector is at least 0,6 times the area of the circular footprint, when the non-circular cross-sections of the first and second portions of the polymer geothermal collector are placed touching each other and simultaneously touching the circular footprint.

The system further comprises the fluid for circulation in the geothermal collector, the fluid has a density of above 1,1 g/cm3 for supporting the wall of the first and second portions of the polymer geothermal collector, when the polymer geothermal collector has been installed in the well.

Having a relatively dense fluid (compared to the water surrounding the collector) supporting the collector from the inside thereof makes it possible to have a non-circular collector with an increased flow area while maintaining the mechanical strength required in deep bore holes.

According to one embodiment, the second length is at least 1,3 times the first length.

According to one embodiment, the second length is at least 1,4 times the first length.

According to one embodiment, the second length is at least 1,5 times the first length.

According to one embodiment, the second length is at least 1,6 times the first length.

According to one embodiment, the second length is at least 1,7 times the first length.

According to one embodiment, the wall of each of the first and second portions of the polymer geothermal collector has a wall thickness in the interval 0,025-0,055 times the sum of the first and second lengths.

According to one embodiment, the combined cross-sectional area of the first and second portions of the polymer geothermal collector is at least 0,7 times the area of the circular footprint.

According to one embodiment, the first cross-sectional distance has a length being in the interval 0,9-1 times the length of the radius of the circular footprint, such that a relatively good connection between the outer surface of the collector and the inner surface of the bore hole can be established.

According to one embodiment, the fluid has a density of above 1150 g/cm3 for supporting the wall of the first and second portions of the polymer geothermal collector when the polymer geothermal collector has been installed in the well.

According to one embodiment, the fluid has a density above 1200 g/cm3 for supporting the wall of the first and second portions of the polymer geothermal collector when the polymer geothermal collector has been installed in the well.

According to one embodiment, the outer surfaces of the non-circular cross-sections of the first and second portions of the polymer geothermal collector, each can be placed touching each other and simultaneously touching the circular footprint in a first and second position, interspaced by a position in which each of the outer surfaces of the cross-sections of the first and second portion of the polymer geothermal collector does not touch the circular footprint.

According to one embodiment, the non-circular cross-sections of the first and second portions of the polymer geothermal collector are elliptical.

According to one embodiment, the polymer geothermal collector has a total length of more than 800 m, such that the polymer geothermal collector is adapted for a well having a depth of more than 400 m.

According to one embodiment, the polymer geothermal collector has a total length of more than 1000 m, such that the polymer geothermal collector is adapted for a well having a depth of more than 500 m.

In one embodiment the geothermal pipe is used for storing heat in a surrounding ground on the outside of the outer pipe and/or for retrieving stored heat from a surrounding ground on the outside of the outer pipe.

The advantages of the uses as defined above are largely analogous to the advantages of the geothermal pipes and collector as described above. That is, the increased efficiency in thermal properties and increased mechanical strength of the pipes.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
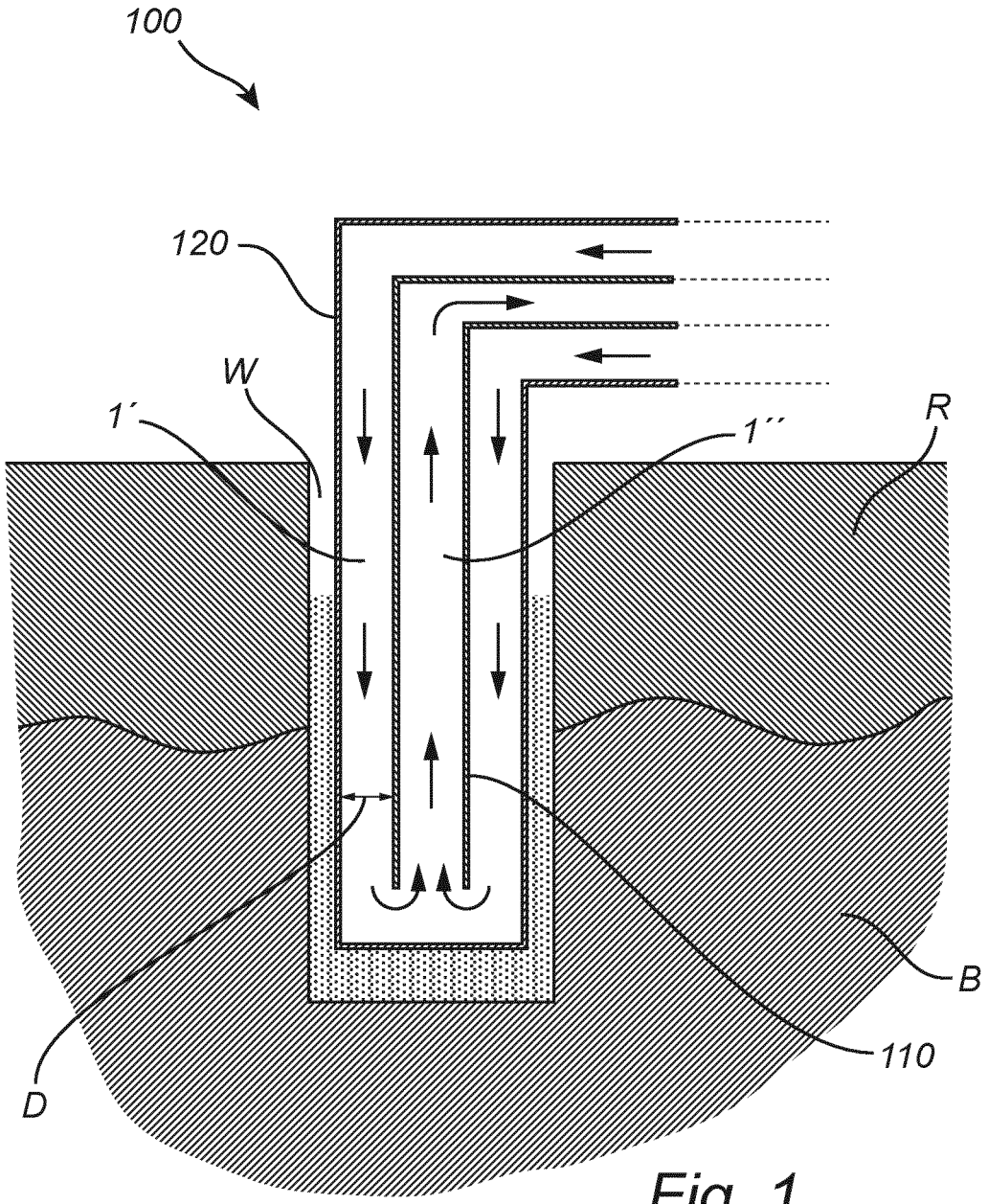
FIG. 1 illustrates a coaxial geothermal pipe collector when placed in a bore hole.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

In the figures and the following examples, the collector pipes are primarily described as individual pipes or mounted together to one other collector pipe. In a collector system there will of course be a plurality of pipes mounted together to form a long geothermal pipe collector, between 200-1000 meters long. That means that if the pipes are 5 meters long there may be 40-200 pipes mounted together in each geothermal pipe collector.

Moreover, in general only sections of the pipe lengths are illustrated in the figures. The lengths are however longer in reality, but in order to illustrate the technical features of e.g., the helical pattern and dimensions etc. only a section of the pipe lengths are illustrated.

In a borehole heat system, a geothermal pipe collector having two fluid conduits are placed in the bore hole, such that fluid can be pumped into the borehole though a first of the two fluid conduits and out from the borehole through a second of the two fluid conduits. In many applications, polymer pipe collectors are used. However, polymer materials are generally relatively good thermal insulators, i.e., have relatively low thermal conductivity and thereby high thermal resistance in comparison with for example metals. This is a drawback when polymer materials are used in heat exchange applications in which heat is to be transferred over the material. For the purpose of reducing the thermal resistance in a geothermal pipe collector, the wall thickness may be decreased. However, decreasing the wall thickness affects the mechanical properties of the collector, which may be a disadvantage for fulfilling the requirements of collector standards and for the handling, installation and operation of the geothermal pipe collector.

When making deep wells or boreholes (the terms will be used as analogues as a drilled borehole forms an energy well when being equipped with a geothermal collector), the pressure-drop in the pipe increases with the depth, which means that a pump needs to work harder to circulate the fluid. This means that the pump consumes more energy, which lowers the efficiency of the heat pump system. The pressure drop is also affected by the available lumen of the collector, i.e., if the fluid conduit is very narrow, the flow resistance will increase and with that the pressure drop over the collector. This means that, for the same outer dimensions, thicker walls of the collector lead to a narrower fluid conduit and more pressure drop.

As heated fluid (or cooled fluid in use cases in which cooling is extracted from the well) is to be transported out from the well, whereas cooler fluid (or warmer fluid in cooling applications) is to be transported into the well, it is a disadvantage when the fluids in the different portions of the collector are affected by each other i.e., such that the heated fluid is cooled by the proximity to the cooler fluid in the bore hole. One way to avoid this thermic contamination is to increase the speed of the flowing fluid, such that the fluids of different temperatures spend less time in proximity of each other. However, the increased flow rate further increases the pressure drop and also reduces the available time that the fluid has for the heat exchange with the bore hole.

Increasing the cross-sectional area of the collector offsets the increasing pressure drop, as the contact area between the fluid and the inner wall of the collector, relative to the volume of fluid transported, is reduced. However, to be able to fit larger collectors in a borehole, the diameter of the borehole needs to be increased which increase the drilling cost.

FIG. 1 shows a system for extracting geothermal energy from a well W, in which a co-axial geothermal pipe collector 100 for extracting geothermal energy from the well W is used. In FIG. 1, the co-axial geothermal pipe collector 100 is placed in the well W or borehole for enabling circulation of a fluid in the co-axial geothermal pipe collector 100, for performing heat exchange between the fluid in the collector 100 and the bedrock B. The co-axial geothermal pipe collector 100 comprises a first fluid conduit 1' for transporting the fluid out from the well W and a second fluid conduit 1" for transporting fluid into the well W. To get a good heat exchange with the ground, and thereby extract a lot of energy, it is important that the co-axial geothermal pipe collector 100 is placed in connection with a material of the ground having relatively high density and thereby storing a lot of energy per unit of volume. The sought-after material in the ground is usually the bedrock B. Bedrock B is a solid rock. Sometimes, the bedrock B is exposed, but in most cases the bedrock lies under looser surface material. The looser surface material is known as regolith R and may be composed of broken and weathered rock material, such as soil or subsoil. To reach the bedrock B it may be necessary to drill through a relatively deep layer of regolith R which may mean that the well W or borehole needs to be made deep for the co-axial geothermal pipe collector 1 to be placed in connection with the bedrock B over a sufficiently long distance to get a sufficient heat exchange.

The co-axial geothermal pipe collector 100 of FIG. 1 comprises an outer pipe 120 for transporting fluid out from into the well W. The outer pipe 120 is configured to be in connection with the inner surface of the bore hole and comprises a fiber reinforced thermoset polymer material. The co-axial geothermal pipe collector 100 further comprises an inner pipe 110 for transporting fluid into the well W. The inner surface is made from a material comprising a second polymer material, different from the fiber reinforced thermoset polymer material. The inner pipe 110 is co-axially arranged in the outer pipe 120, at a distance D from the outer pipe 120. The inner pipe 110 has an average wall thickness being thicker than the average wall thickness of the outer pipe 120, more specifically, the average wall thickness of the inner pipe 110 is more than 1,1, times the average wall thickness of the outer pipe 120. In alternative embodiments, the average wall thickness of the inner pipe 110 is more than 1,2, times the average wall thickness of the outer pipe 120, or the average wall thickness of the inner pipe 110 is more than 1,3, times the average wall thickness of the outer pipe 120. The average wall thickness being defined as the average wall thickness of the portion of the geothermal pipe collector 100 placed in the well.

Figure 2:
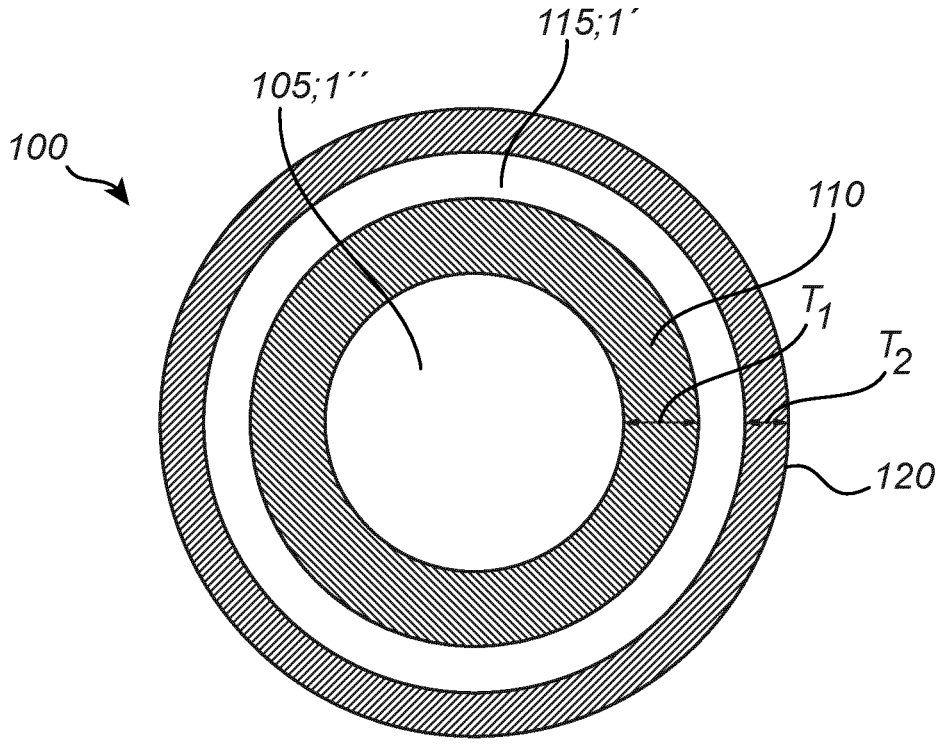
FIG. 2 illustrates a cross-section of a coaxial geothermal pipe collector according to one embodiment.

FIG. 2 shows a cross-sectional view of the geothermal pipe collector 100, looking along the central longitudinal axis of the geothermal pipe collector 100. In FIG. 2, a co-axial geothermal pipe collector 100 is illustrated, where the inner pipe 110 has a central longitudinal lumen 105 forming the second conduit 1" in which thermal fluid can flow. In the embodiment shown in FIG. 2, the fluid flows in an upwards direction in the first conduit 1', and in a downwards direction in the second conduit 1". The advantage of this flow direction is that the pressure will be somewhat higher in the second conduit 1" than in the first conduit 1' (due to the pressure drop over the length of the geothermal pipe collector 100). This higher pressure will support the inner pipe 110 which is of particular importance when the inner pipe is made from a more resilient rubber-based material, such as EPDM. The support will maintain the circular shape of the inner pipe 110 and prevent it from altering shape or collapsing, which would affect the flow in the geothermal pipe collector 100.

However, in some embodiments, it is possible that the direction would either be the opposite, or even that the direction could change depending on if the system is used for storing heat or retrieving heat from a bore hole at the time. The cross-sectional area of the intermediate longitudinal lumen 115, i.e. the cross sectional area of the lumen of the inner pipe minus the cross-sectional area of the outer pipe, is preferably about the same as the cross-sectional area of the central longitudinal lumen 105 (i.e. the lumen of the inner pipe), as this will allow the same fluid flow velocity, i.e. flow rate, in both directions, which will minimize the pressure drop.

It however in the alternative possible to have a larger cross-sectional area of the central longitudinal lumen 105, as the fluid will then flow slower in the central longitudinal lumen 105, which leads to a more laminar flow. Just as the increased turbulence increases the heat exchange between the wall and the fluid flowing in the lumen, a more laminar flow will decrease the heat exchange between the wall and the fluid flowing in the lumen. In the embodiment shown in FIG. 2, decreased turbulence in the fluid flowing in the central longitudinal lumen 105 will reduce the heat transfer over the wall of the inner pipe and thus the heat exchange between the fluid in the central longitudinal lumen 105 and the fluid in the intermediate longitudinal lumen 115, which will increase the efficiency of the geothermal pipe collector 100. In the embodiment shown in FIG. 2, the central longitudinal lumen 105 has a cross-sectional area in a plane perpendicular to the central longitudinal axis of the geothermal pipe collector 100 being 1,1 times as large as a cross-sectional area of the intermediate longitudinal lumen 115 in the same plane.

The outer pipe 120 is made from a fiber reinforced thermoset polymer material. Fiber reinforced thermoset polymer materials are very durable and as such the outer pipe 120 can be made relatively thin. In the embodiment shown in FIG. 2, the outer pipe has an average wall thickness T2 in the range 2 mm-6 mm, or more preferably 2 mm-4 mm. Having a relatively thin average wall thickness T2 reduces the thermal resistance of the outer pipe 120 which increases the heat exchange between the bore hole and the fluid on the inside of the wall of the outer pipe 120. The fiber reinforced thermoset polymer material could comprise a cured epoxy or polyester resin, which apart from being durable also has the advantage that it maintains its mechanical properties even under relatively high temperatures (for geothermal applications) such as temperatures above 80° C. Cured epoxy resin have a thermal conductivity in the range 0,17-0,22 W/mK, more specifically about 0,19 W/mK. The fiber reinforced thermoset polymer material may further comprise glass fibers of carbon fibers. Glass fibers and carbon fibers increase the mechanical properties, tensile strength, stiffness and durability of the thermoset polymer material and enables a reduction of the wall thickness and thereby the thermal resistance.

The inner pipe 110 is made from a second polymer material, which is different from the fiber reinforced thermoset polymer material. The polymer material of the inner pipe 110 may be a polymer material having a higher thermal resistance than the fiber reinforced thermoset polymer material to provide better insulation between the fluid in the intermediate longitudinal lumen 115 and the fluid in the central longitudinal lumen 105. The polymer material of the inner pipe 110 may be a polymer material having a 10% higher thermal resistance than the fiber reinforced thermoset polymer material, or a 20% higher thermal resistance than the fiber reinforced thermoset polymer material, or a 30% higher thermal resistance than the fiber reinforced thermoset polymer material. The inner pipe 110 has an average wall thickness T1 being thicker than the average wall thickness T2 of the outer pipe 120 which increases the thermal resistance of the inner pipe 110 which enables the thermal resistance of the inner pipe to be higher than the thermal resistance of the outer pipe 120, which reduces the heat transfer between the fluid transported in the inner pipe 110 and the fluid transported in the intermediate longitudinal lumen 115 between the outer and inner pipes 120,110, which in turn increases the heat exchange efficiency of the geothermal pipe collector 100.

In FIG. 2, the second polymer material is more elastic than the fiber reinforced thermoset polymer material. The second polymer material may be more than 10% more elastic than the fiber reinforced thermoset polymer material, or 20% more elastic than the fiber reinforced thermoset polymer material, or 30% more elastic than the fiber reinforced thermoset polymer material. This makes handling of the inner pipe 110 easier, for example by the inner pipe 110 being possible to coil, such that the entire inner pipe can be manufactured and handled in a single length, which would remove the need for assembly of the inner pipe 110 when the geothermal pipe collector 100 is installed. The second polymer material could for example comprise a PVC-based material. PVC-based material has relatively low thermal conductivity, i.e. high thermal resistance compared to PE-based materials. The general properties of PVC is a specific weight in the range 1,3-1,5 g/cm3, more specifically about 1,4 g/cm3, a modulus of elasticity in the range 2-7 GPa, more specifically about 3 GPa and a thermal conductivity in the range 0,12-0,25 W/mK, more specifically about 0,20 W/mK.

In the alternative, the second polymer material may comprise a natural rubber-based material, and/or a synthetic rubber-based material. Rubber-based materials have the advantage that they maintain their mechanical properties also when exposed to temperatures exceeding 80° C., which enables the use of the geothermal pipe collector 100 also in applications in which fluid temperatures above 80° C. is desired. Such applications could for example be storage of waste heat in the ground during the warmer parts of the year, for use during the cooler parts of the year. Synthetic rubber, specifically EPDM, has a thermal conductivity in the range 0,25-0,31 W/mK, more specifically about 0,29 W/mK. Synthetic rubber, or specifically EPDM, has a modulus of elasticity of about 6 MPa which enables an inner pipe made of EPDM to be coiled.

In the embodiment shown in FIG. 2 the inner pipe 110 has an average wall thickness T1 which is thicker than the average wall thickness T2 of the outer pipe 120. In the embodiment shown in FIG. 2, the inner pipe 110 has an average wall thickness T1 being more than 10% thicker than the average wall thickness T2 of the outer pipe 120, more preferably more than 20% thicker than the average wall thickness T2 of the outer pipe 120, and even more preferably more than 30% thicker than the average wall thickness T2 of the outer pipe 120.

In the embodiment shown in FIG. 2, the average wall thickness T2 of the outer pipe 120 is less than 3 mm, preferably in the range 2 mm-4 mm.

In the embodiment shown in FIG. 2, the average wall thickness T1 of the inner pipe 110 is preferably in the range 3 mm-7 mm, more preferably in the range 4 mm-6 mm. In the embodiment of FIG. 2, the inner pipe 110 has an average wall thickness T1 of more than 4,5 mm, and the outer pipe 120 has an average wall thickness T2 of less than 3,5 mm.

A further advantage with keeping the average wall thickness relatively low is that, for the same size of bore hole, an increasing wall thickness leads to a decrees of the total lumen cross-sectional area, such that the area available for fluid conduits becomes less, which increases the pressure drop in the system provided that the same amount of fluid is to be circulated.

The outer dimensions of the inner and outer pipes 110, 120 may vary depending on the capacity of the coaxial collector. Typically, the outer pipe 120 may have an outer diameter ranging from 60-200 mm, preferably from 75-120 mm, more preferably from 80-115 mm and most preferably from 85-95 mm. Typically, the inner pipe 110 has an outer diameter ranging from 30-130 mm, preferably from 40-70 mm, more preferably from 30-60 mm.

The polymer materials of the inner and outer pipes 110, 120 may comprise one or several fillers, such as carbon black or another paracrystalline carbon. In the embodiment shown in FIG. 2, the polymer material of the inner pipe 110 comprises carbon black in the range 10%-20%, preferably less than 15%. Carbon black has a specific weight of 1,8-2,1 g/cm3 and the addition of carbon black thus increase the specific weight of the collector, which would be an advantage when the collector is made from a material enclosing gas, such further described with reference to FIG. 4B. The addition of Carbon Black also increases the durability of the polymer material and provides protection against UV-radiation. The plastic material (including the major polymer component (such as PVC or EPDM), fillers and additives) that forms of the inner and/or outer pipes 110,120 may have a specific weight being more than 3% higher than the major polymer component of the plastic material or may have a specific weight being more than 5% higher than the major polymer component, or may have a specific weight being more than 7% higher than the major polymer component.

In the embodiment shown in FIG. 2, the outer pipe 120 has a lower thermal resistance than the inner pipe 110. The thermal resistance of the outer pipe 120 is preferably less than 90% of the thermal resistance of the inner pipe 110, more preferably less than 80% of the thermal resistance of the inner pipe 110, and even more preferably less than 70% of the thermal resistance of the inner pipe 110. The thermal resistance is a result of a combination of the properties of the material and the average wall thickness.

Figure 3A:
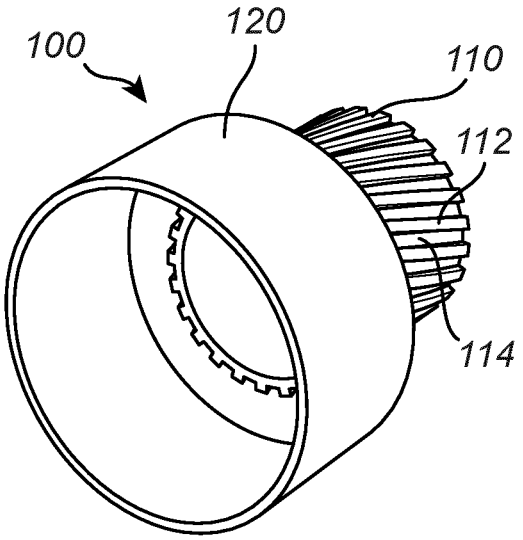
FIG. 3A illustrates a coaxial geothermal pipe collector according to one embodiment, in a perspective view.

FIG. 3A illustrates a perspective view of a section of a geothermal pipe collector 100 comprising an inner pipe 110 and outer pipe 120 according to one embodiment. The inner and outer pipes 110, 120 are axially displaced for clarity reasons. In a real application, the inner and outer pipes 110, 120 will obviously extend axially aligned. The inner pipe 110 is coaxially arranged inside the outer pipe 120. In FIG. 3*a* the inner pipe 110 comprises a helical pattern on its outside surface. The pattern comprises helical projections 112 and intermediary helical grooves 114. The purpose of this helical pattern 112,114 is mainly to obtain a turbulent flow of a fluid flowing in the intermediate longitudinal lumen 115. The turbulent flow increases the heat exchange as the fluid is constantly mixed which avoids layers of different temperatures in the fluid flow. In the opposite way, a laminar flow creates layers of different temperatures which reduces the heat transfer. Moreover, the turbulent flow may have the advantage that build-up of deposition on the inside of the pipe can be avoided. By avoiding build-ups of depositions decreased efficiency over time is avoided.

The advantage in making the helical patters on the outside of the inner pipe 110 instead of on the inside of the outer pipe 120, is that the additional material needed to enable the creation of the helical pattern is added only to the inner pipe 110, which means that the average wall thickness of the outer pipe 120 can be kept as thin as possible.

Figure 3B:
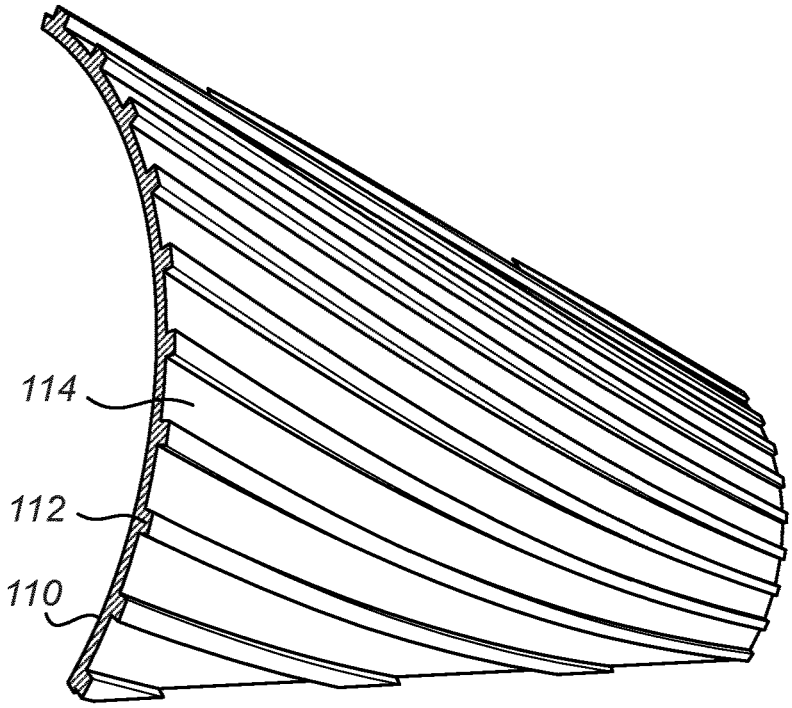
FIG. 3B illustrates a wall portion of an inner pipe of a coaxial geothermal pipe collector, in a perspective view.

FIG. 3B shows a section of the inner pipe 110 of FIG. 3A with the helical pattern built up from the protrusions 112 and grooves 114 on its outer surface. The protrusions 112 and the grooves 114 may vary as described in relation to FIGS. 3D and 3E, both in terms of height, numbers, distribution and rotation ratio. From FIG. 3B it is clear that the helical pattern rotates on the outside of the inner pipe 110. In a longer section of the inner pipe 110, the pattern may conclude an entire 360 degrees rotation every 50 cm, ever meter, every $2^{nd}$ meter, every $4^{th}$ meter or every $6^{th}$ meter.

Figure 3C:
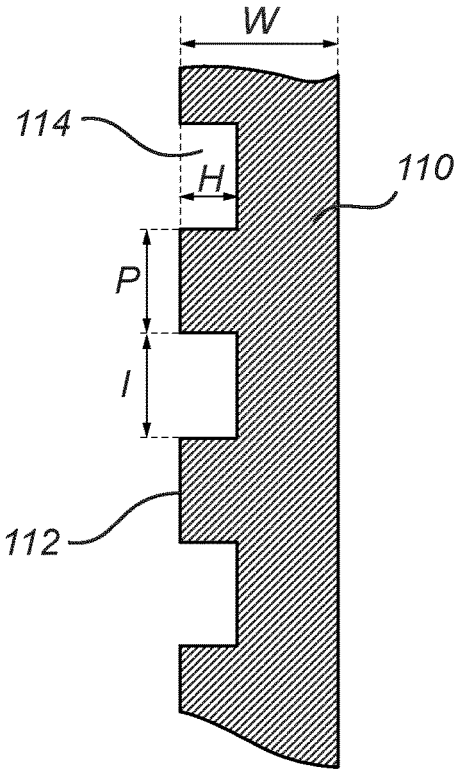
FIG. 3C illustrates a cross-section of a portion of a wall of an inner pipe of a geothermal pipe collector according to one embodiment.
Figure 3D:
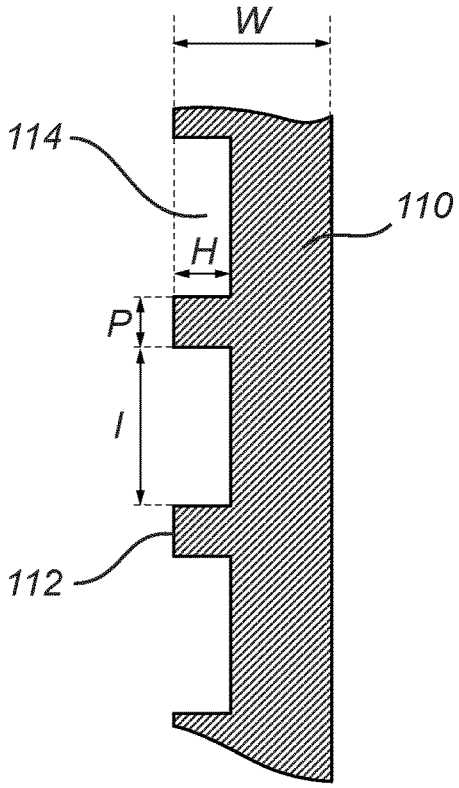
FIG. 3D illustrates a cross-section of a portion of a wall of an inner pipe of a geothermal pipe collector according to one embodiment.

FIGS. 3C and 3D shows two alternative embodiments of the grooved outer surfaces of the inner pipe 110. The grooves 114 have a rectangular shape. In this illustrated embodiment, all of the grooves 114 have a rectangular shape with a width I and a depth corresponding to the height H of the protrusions 112. The grooves 114 may be uniform in shape, but the shape could vary throughout the cross-section of the inner pipe 110. The grooves 114 could also have other shapes, such as triangular, rounded, half-moon shape (not shown) or any other form. Further the width P of the protrusions 112 are also illustrated in the figure.

In the embodiment shown in FIG. 3C, the width I of the indentations are wider with respect to the width P of the protrusions 112. It is however equally plausible that the relationship is reversed. It is also plausible that the widths P and I are identical. In both the embodiment of FIG. 3C and the embodiment of FIG. 3D, the height H of the protrusions 112 (which is equal to the depth of the grooves 114) is preferably between 0,01 and 0,2 times the average wall thickness W of the inner pipe 110. The height H of the protrusions 112 is preferably between 0,001 and 0,05 times the diameter of the inner pipe 110. It is however plausible that the height H of the protrusions 112 is between 0,005 and 0,01 times the diameter of the inner pipe 110.

In FIG. 3C, width I of the grooves 114 is equal to the width P of the protrusions 112. In FIG. 3D however, the width I of the grooves 114 is wider than the width P of the protrusions 112. It is equally plausible however, that the width P of the protrusions 112 would be wider than the width I of the grooves 112. This also applies to the ratio on any helical pattern.

The width I of the grooves and the width P of the protrusions is preferably between 0,1 and 5 times the average wall thickness W of the inner pipe 110. The height H of the indentations and/or protrusions can be varied but can typically be within the range of 0.1-2 mm depending on the size of the pipes and the average wall thickness. Preferably the height H is between 0.2 and 1 mm.

Figure 4A:
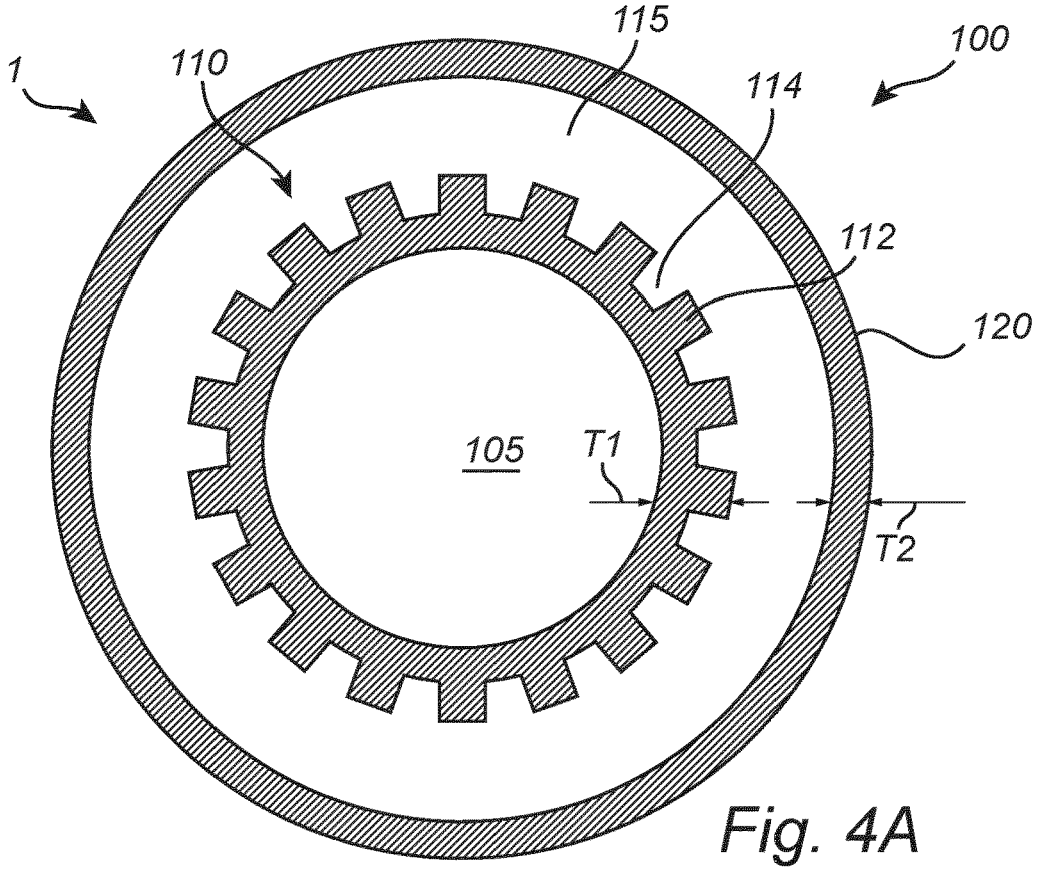
FIG. 4A illustrates a cross-section of a coaxial geothermal pipe collector according to one embodiment.

FIG. 4A shows a cross-sectional view of the geothermal pipe collector 100 according to the embodiment shown in FIGS. 3A and 3B. The outer pipe 120 is made from a fiber reinforced thermoset polymer material and the inner pipe 110 is made from a second polymer material, which is different from the fiber reinforced thermoset polymer material. The polymer material of the inner pipe 110 may be a polymer material having a higher thermal resistance than the fiber reinforced thermoset polymer material to provide better insulation between the fluids in the intermediate longitudinal lumen 115 and the central longitudinal lumen 105. In the embodiment of FIG. 4A, the inner pipe 110 has an average wall thickness T1 being thicker than the average wall thickness T2 of the outer pipe 120 which enables the thermal resistance of the inner pipe 110 to be higher than the thermal resistance of the outer pipe 120, which reduces the heat transfer between the fluid transported in the inner pipe 110 and the fluid transported between the outer and inner pipes 120, 110, which in turn increases the heat exchange efficiency of the geothermal pipe collector 100.

The inner pipe 110 has a helical groove 114 on the outer surface, facing the outer pipe 120 for creating a turbulent flow of the fluid in the intermediate longitudinal lumen 115, between the inner and outer pipes 110, 120. The turbulent flow increases the heat exchange between the fluid and the wall of the outer pipe 120 which thus increases the heat exchange between the inside of the bore hole and the fluid in the geothermal pipe collector 100.

According to the embodiment shown in FIG. 4A, the grooves 114 are placed equidistantly across the cross-section. It is however plausible that the grooves 114 are placed at varying intervals across the cross-section (such as for example shown in FIG. 3D). In the embodiment shown in FIG. 4A, the groove 114 runes continuously along the entire length of the inner pipe 110. However, in alternative embodiments it is equally conceivable that different sections of the pipe in the longitudinal direction could have different number of grooves 114. Some sections of the pipe may even be flat and contain no grooves at all. The wording "grooves and protrusions" are to be understood as that the pipe should have two different thicknesses. The word "protrusion" is not limited to that a material should be added to the wall, nor is the wording groove limited to that a material needs to be removed from the wall. The wording is simply used to describe a relative thickness of the pipe wall at the groove and at the protrusion.

Figure 4B:
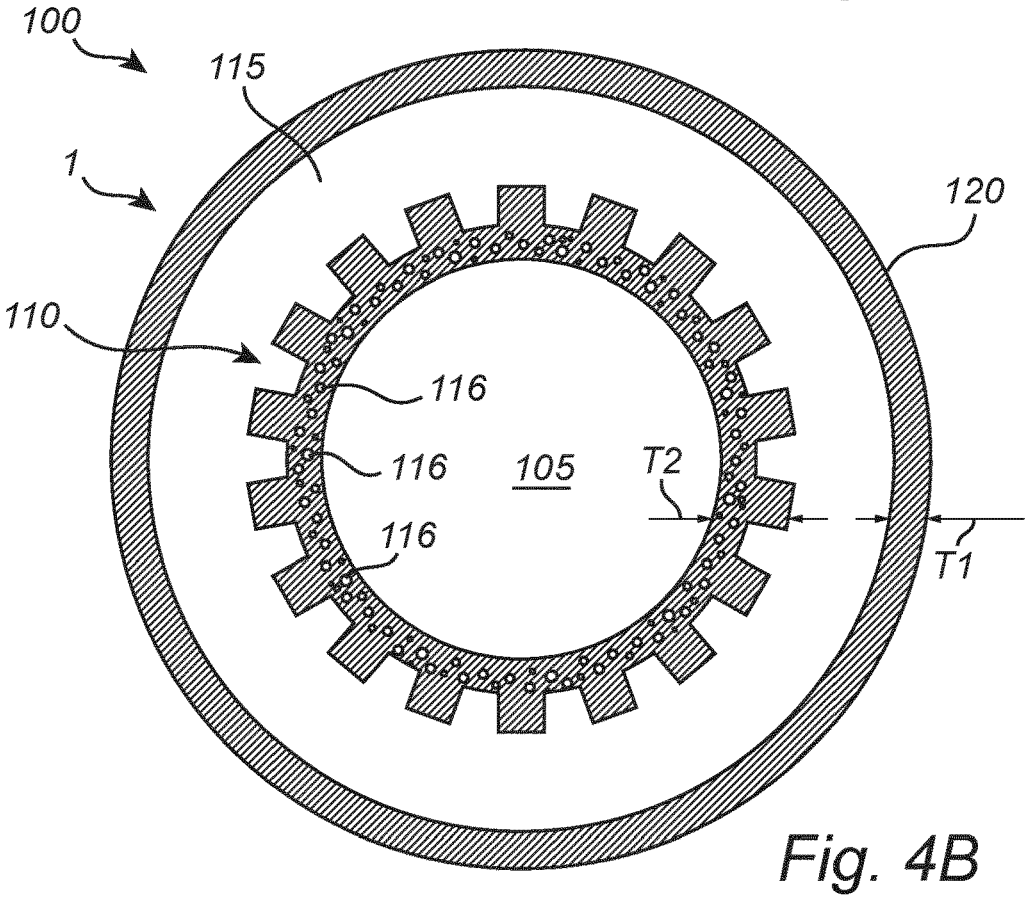
FIG. 4B illustrates a cross-section of a coaxial geothermal pipe collector according to one embodiment.

FIG. 4B shows an embodiment of the geothermal pipe collector 100 similar to the embodiment shown in FIG. 4A, the difference being that the material of the inner pipe 110 comprises more gas measured in volume percentage than the material of the outer pipe 120. More specifically, the material of the inner pipe 110 comprises a plurality of volumes of gas 116 enclosed by an enclosing material, which in turn is enclosed by the second polymer material of the inner pipe 110, for increasing the thermal resistance of the second polymer material. In the embodiment of FIG. 4A, the enclosing material is glass, which is harder and heavier than the second polymer material. The plurality of volumes of gas enclosed by an enclosing material, such as glass, makes up at least 3 volume percent of the material of the inner pipe, more preferably at least 5 volume percent of the material of the inner pipe, and even more preferably less than 10 volume percent of the material of the inner pipe. The glass enclosed bubbles 116 reduces the density of the material and increases the thermal resistance, which thus enhances the insulating properties of the second polymer material, which reduces the heat exchange between the fluid in the intermediate longitudinal lumen 115 and the central longitudinal lumen 105. To optimize the performance of the coaxial geothermal pipe collector 100, while maintain the ability to easily install the geothermal pipe collector in the bore hole, gas filled glass bubbles may be added to the second polymer material as much as possible to increase the thermal resistance of the inner pipe 110, while still maintain a specific weight of the material of the inner pipe exceeding 1 g/cm3 (i.e. higher than water), such as the inner pipe 110 sinks when installed in the fluid filled bore hole, such that the inner pipe 110 does not have to be forced into the fluid filled bore hole.

Figure 5:
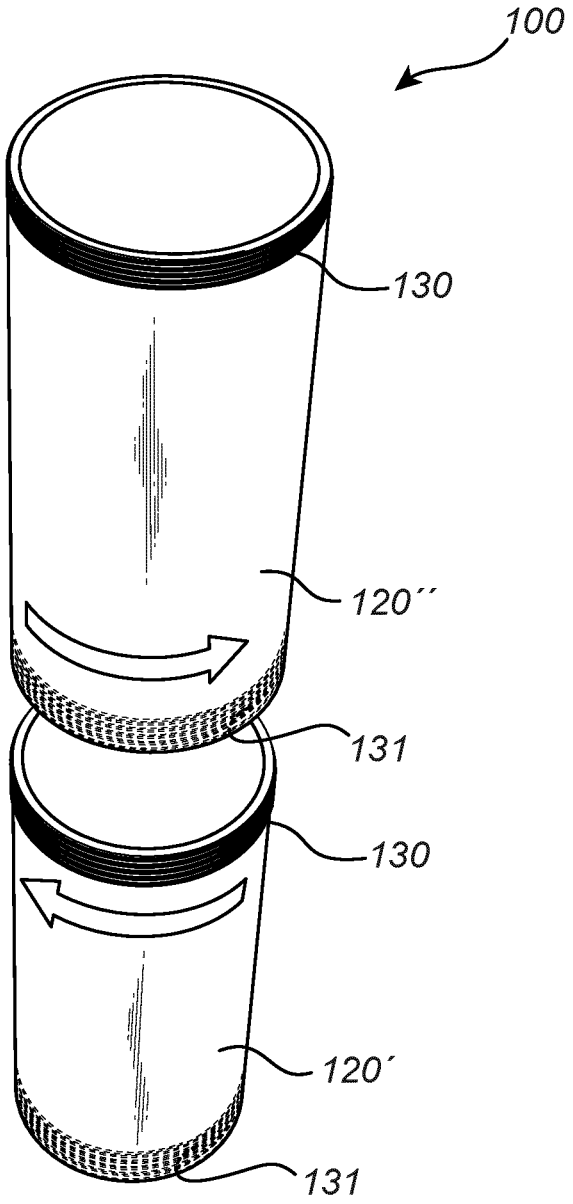
FIG. 5, is a perspective illustration of two outer pipes of a coaxial geothermal pipe collector when being assembled by means of a thread.

FIG. 5 shows a coaxial geothermal pipe collector system comprising coaxial geothermal pipe collectors 100 according to any of the embodiments herein, and a method of connecting a plurality of outer pipes 120', 120" of the coaxial geothermal pipe collectors 100 to each other. The method of connecting a plurality of outer pipes 120', 120" of the geothermal pipe collectors 100 to each other comprises providing a first outer pipe 120" into a bore hole and bringing a second outer pipe 120" in abutment with the first outer pipe 120'. The method then comprises rotating the second outer pipe 120" relative the first outer pipe 120', so as to couple the first outer pipe 120' to the second outer pipe 120" by means of two matching threads 130, 131. I.e. a first portion of the first outer pipe 120' comprises an outer threaded portion 130 having threads that corresponds to an inner threaded portion 131 of the second outer pipe 120".

The method of connecting the outer pipes 120', 120" to each other may be followed by the method of installing an inner pipe inside of the plurality of connected outer pipes 120', 120". The method of installing the inner pipe in the outer pipe 120 could comprise connecting a plurality of inner pipes to form a connected inner pipe or could comprise installing a single inner pipe for example provided on a coil into the outer pipe. In embodiments in which the installation of the inner pipe comprises connecting a plurality of inner pipes, such plurality of inner pipes may comprise threaded portions such that they are connected to each other by means of rotating a first inner pipe in relation to a second inner pipe. I.e., a first portion of the first inner pipe comprises an outer threaded portion having threads that corresponds to an inner threaded portion of the second inner pipe.

In embodiments where the step of installing the inner pipe in the outer pipe comprises installing a single inner pipe provided on a coil, the material of the inner pipe is preferably a material based on a natural or synthetic rubber, such as EPDM, as such material are resilient enough to coil.

The method of connecting a plurality of outer and inner pipes to each other may optionally comprise the step of applying an adhesive to the threaded portions, such that the threaded connection is further supported by adhesive.

The method steps of installing the inner pipe in the outer pipe may comprise installing a spacer between the inner and outer pipes, so as to center the inner pipe in the outer pipe.

The coaxial geothermal pipe collector system may further comprise the fluid for circulation in the coaxial geothermal pipe collector system. The fluid may have a density (in relation to water at 4° C., having a density of 1) of above 1,1 g/cm3 for supporting the wall of the outer pipe 120 of the polymer geothermal collector 100, when the coaxial geothermal pipe collector 100 has been installed in the well. Having a high-density fluid may be particularly important in deep bore hole applications, as the pressure from the ground surrounding the bore hole increases with the depth of the bore hole. The fluid for circulation in the geothermal collector could preferably have a relative density to water or specific weight (density) in the interval 1,1-1,3 g/cm3. The fluid for circulation in the geothermal collector could for example be the fluid Kilfrost GEO, diluted with water in concentrations in the range 24%-60%, available from Kilfrost Limited, Albion Works, Haltwhistle, Northumberland NE49 OHJ, UK.

When assembled, the assembled coaxial geothermal pipe collector for transporting the fluid may have a total length of more than 200 meters, preferably more than 300 meters, preferably more than 400 meters, preferably more than 600 meters, preferably more than 800 meters.

The assembled coaxial geothermal pipe collector could be suitable for use in relatively high temperature applications, specifically applications in which a fluid having a temperature of above 80° is used. In such applications the use of a coaxial geothermal pipe collector made from a synthetic rubber, such as EPDM is particularly suitable as the mechanical properties of EPDM does not change very much when heated to a temperature of about 80° C. High temperature applications are specifically advantageous in systems for storing heat in a surrounding ground on the outside of the outer pipe and/or for retrieving stored heat from a surrounding ground on the outside of the outer pipe.

Figure 6:
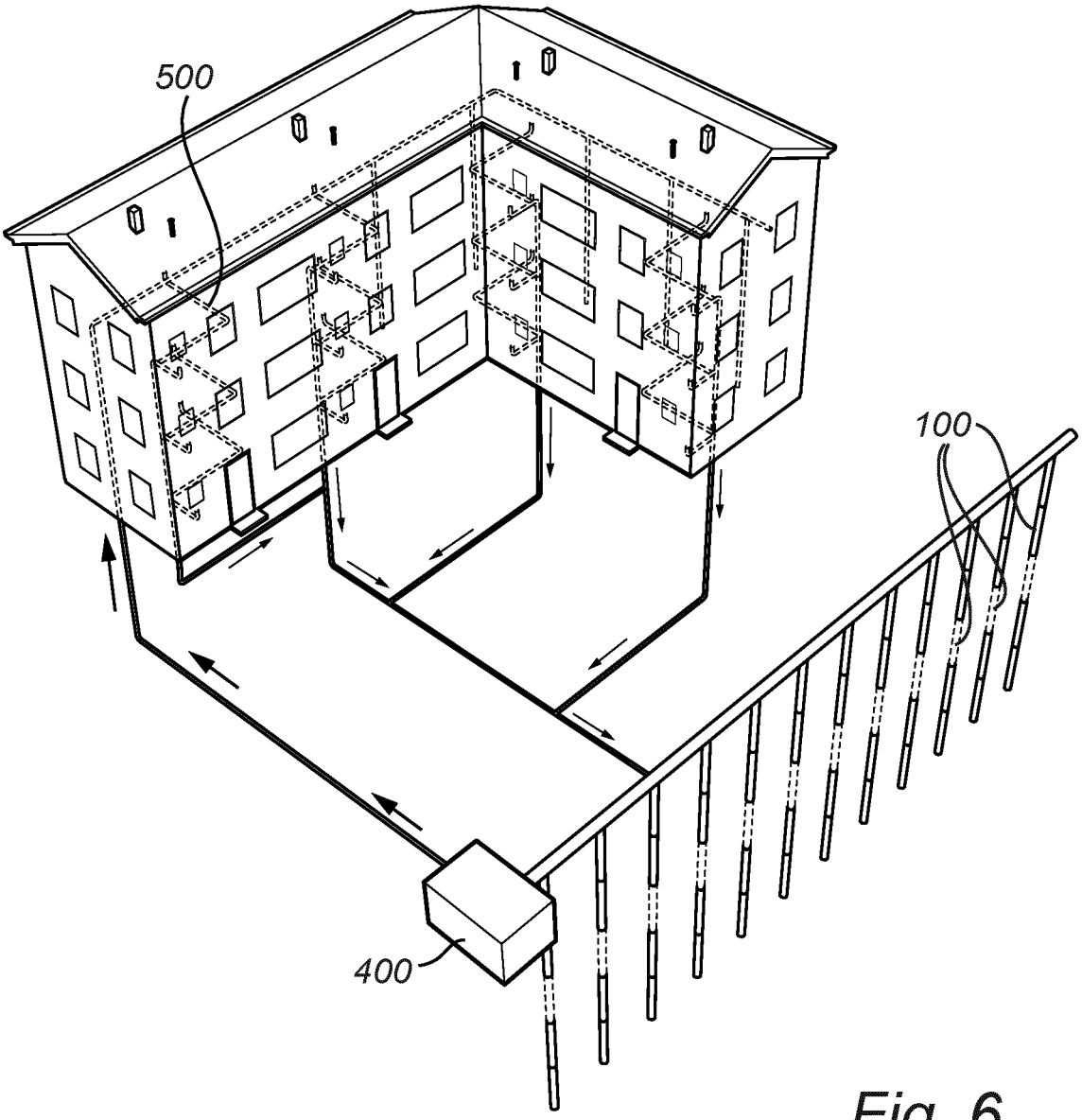
FIG. 6 illustrates a building with a heat exchange system coupled to a coaxial collector system.

FIG. 6 illustrates a building 500 having a heat pump 400 schematically coupled to the house for providing a heating and/or cooling function to the building. The heat pump 400 is fluidly coupled to a coaxial collector system comprising a plurality of geothermal coaxial collectors 100. The total length of each coaxial collector may be at least 200 meters, preferably more than 400 meters, preferably more than 600 meters, preferably more than 800 meters. The length may be different for each of the collectors, depending on the conditions in the ground which the bore is made in. The heat pump may hereby be fluidly coupled to a plurality of coaxial collector assemblies, arranged in different bore holes for increasing the capacity of heat storage and heat retrieval.

Lately, there has been an increased interest in drilling deeper wells. It may be so that the rock providing good energy storage and/or conductivity is located at larger depths with e.g., a thick layer of sand above. It may also be so that the absence of space makes it important to reduce the number of holes drilled for extracting a specific amount of heat.

When making deep wells or boreholes (the terms will be used as analogues as a drilled borehole forms an energy well when being equipped with a geothermal collector), the pressure-drop in the pipe increases which means that a pump needs to work harder to circulate the fluid. This means that the pump consumes more energy, which lowers the efficiency of the heat pump system.

As heated (or cooled) fluid is to be transported out from the well, whereas cooler (or warmer) fluid is to be transported into the well, it is a disadvantage when the fluids in the different portions of the collector are affected by each other i.e., such that the heated fluid is cooled by the proximity to the cooler fluid in the bore hole. One way to avoid this thermic contamination is to increase the speed of the flowing fluid, such that the fluids of different temperatures spend less time in proximity of each other. However, the increased flow rate further increases the pressure drop.

Increasing the cross-sectional area of the collector offsets the increasing pressure drop, as the contact area between the fluid and the inner wall of the collector, relative to the volume of fluid transported, is reduced. However, to be able to fit larger collectors with a circular cross-section in a borehole having a circular cross-section, the diameter of the borehole needs to be increased.

Drilling a borehole having a larger diameter is more expensive and takes longer time.

It is therefore advantageous to use a geothermal collector having a non-circular cross-section, i.e., having a first cross-sectional distance having a first length and a second cross-sectional distance having a second longer length, in a plane perpendicular to the length extension of the geothermal collector.

The disadvantage with non-circular geothermal collectors is that the less optimal shape makes them mechanically weaker. This could be offset by increasing the wall thickness, but an increase in wall thickness increases the insulating effect of the polymer material which reduces the heat transfer capabilities of the geothermal collector making the system less effective.

As such, geothermal collectors having a non-circular cross-section are generally unsuitable for deep boreholes as the external forces acting on the geothermal collector increases with the depth.

The present invention however offers a solution to the above stated problem. By using a fluid for circulation in the geothermal collector having a density of above 1,1 g/cm3, a geothermal pipe collector having a non-circular cross-section may be used also in deep boreholes. The dense fluid supports the geothermal pipe collector from within and enables the use of a non-circular pipe collector in deep boreholes without need to increase the wall thickness.

Figure 7:
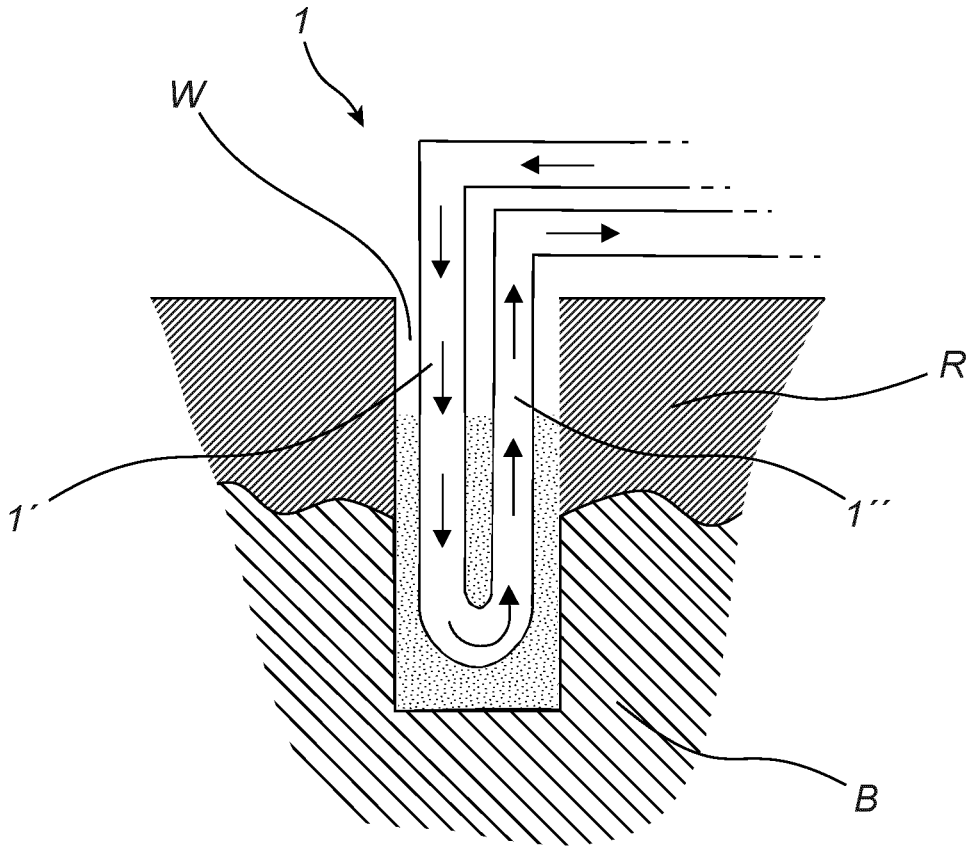
FIG. 7 shows a system for extracting geothermal energy from a well, in which a polymer geothermal collector for extracting geothermal energy from the well is used, in a cross-sectional view.

FIG. 7 shows a system for extracting geothermal energy from a well W, in which a polymer geothermal collector 1 for extracting geothermal energy from the well W is used. In FIG. 7, the polymer geothermal collector 1 is placed in the well W or borehole for enabling circulation of a fluid in the polymer geothermal collector 1, for performing heat exchange between the fluid in the collector and the bedrock B. The geothermal collector 1 comprises a first portion 1' for transporting the fluid into the well W and a second portion 1" for transporting fluid out from the well W. To get a good heat exchange with the ground, and thereby extract a lot of energy, it is important that the polymer geothermal collector 1 is placed in connection with a material of the ground having relatively high density and thereby storing a lot of energy per unit of volume. The sought-after material in the ground is usually the bedrock. Bedrock B is a solid rock.

Sometimes, the bedrock B is exposed, but in most cases the bedrock lies under looser surface material. The looser surface material is known as regolith R and may be composed of broken and weathered rock material, such as soil or subsoil. To reach the bedrock B it may be necessary to drill through a relatively deep layer of regolith R which may mean that the well W or borehole needs to be made deep for the polymer geothermal collector 1 to be placed in connection with the bedrock B over a sufficiently long distance to get a sufficient heat exchange.

In FIG. 7, the well has a depth of more than 400 m, and as such the polymer geothermal collector 1 has a total length of more than 800 m, in particular the well has a depth of more than 500 m, and as such the polymer geothermal collector 1 has a total length of more than 1000 m.

Figure 8:
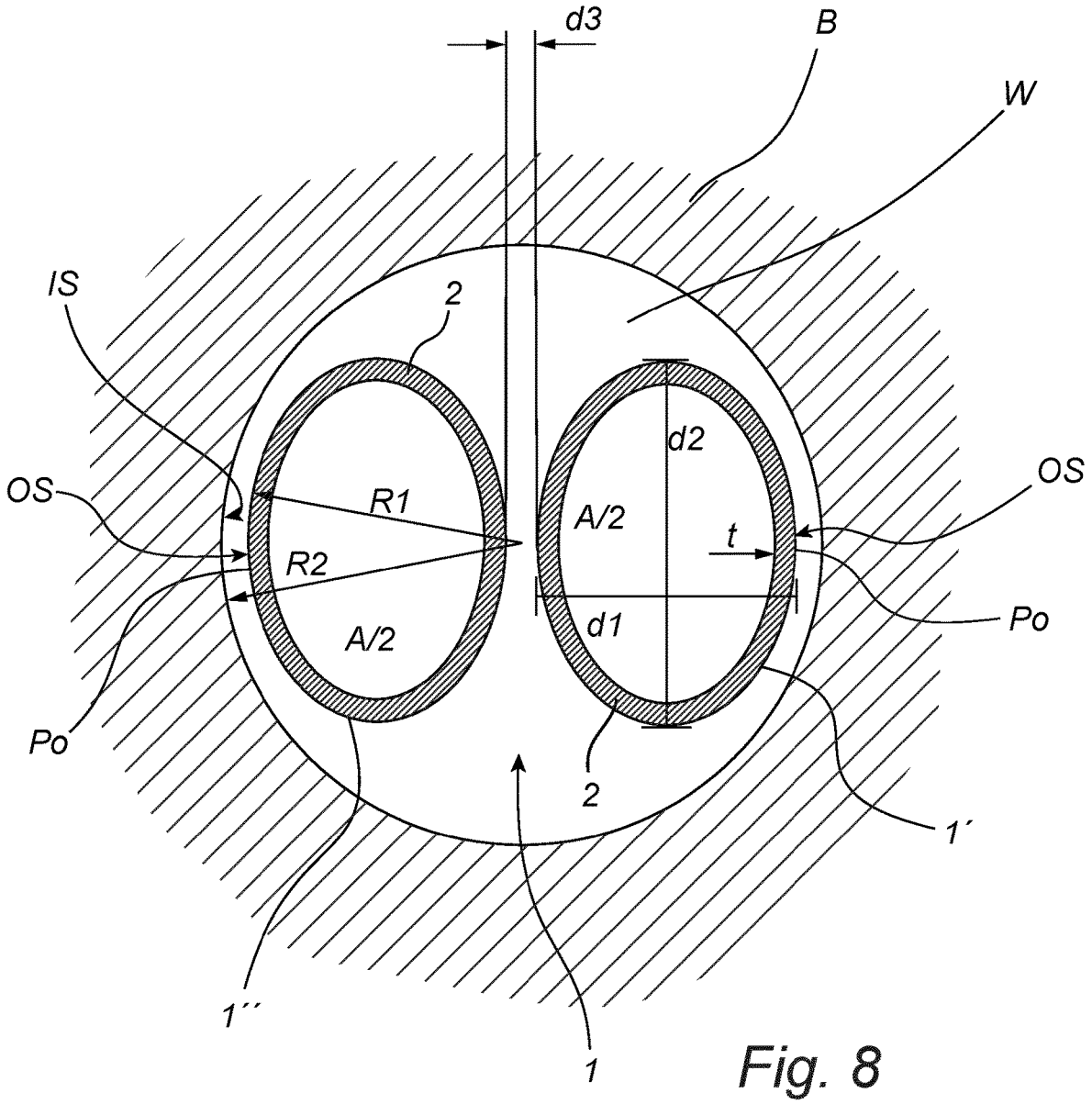
FIG. 8 shows a cross-sectional view of the well and the polymer geothermal collector, showing the first and second portions of the polymer geothermal collector, each have a non-circular cross-section.

FIG. 8 shows a cross-sectional view of the well W and the polymer geothermal collector 1, showing the first and second portions 1',1" of the polymer geothermal collector 1. Each of the first and second portions 1',1" have a non-circular cross-section, having a first cross-sectional distance d1 having a first length and a second cross-sectional distance d2 having a second length, in a plane perpendicular to the length extension of the polymer geothermal collector 1. In the embodiment shown in FIG. 2 the second length is more than 1,2 times the first length, and more than 1,3 times the first length, in particular about 1,4 times the first length.

The wall 2 of each of the first and second portions 1',1" of the polymer geothermal collector 1 has a wall thickness t in the interval 0,02-0,06 times the sum of the first and second lengths, and in the interval 0,025-0,055 times the sum of the first and second lengths.

In FIG. 8, the portions of the outer surfaces OS facing the inner surface IS of the borehole of the non-circular cross-sections of the first and second portions 1',1" are curved with a curvature having substantially the same radius R1 as the radius R2 of the curvature of the inner surface IS of the borehole at the central point p0, such that a relatively long contacting surface can be created between the outer surfaces OS of the first and second portions 1',1" of the polymer geothermal collector 1, and the inner surface IS of the borehole, which increases the heat transfer between the borehole the polymer geothermal collector. The radius R1 is preferably in the interval 0,9-1,1 times the radius R2.

In FIG. 8, the first and second portions 1',1" of the polymer geothermal collector 1 are placed with a distance d3 from each other. Having a distance insulates the first portion 1' of the polymer geothermal collector 1 from the second portion 1" of the polymer geothermal collector 1, which decreases the cooling effect that the cooler fluid transported into the well though the first portion 1' of the polymer geothermal collector 1 will have on the warmer fluid transported out from the well through the second portion 1" of the polymer geothermal collector 1. The distance may be more than the thickness t of the wall 2 of the polymer geothermal collector 1, or may be more than two times the thickness t of the wall 2 of the polymer geothermal collector 1, or may be in the interval 1-3 times the thickness t of the wall 2 of the polymer geothermal collector 1. The insulating effect of the distance d3 must be weighed against the space such distance takes in the borehole, which reduces the available space for the cross-sectional area of the first and second portions 1',1" of the polymer geothermal collector 1, or creates the need to increase the diameter of the bore hole which is more resource demanding.

In FIG. 8 the combined cross-sectional area A of the first and second portions 1',1" (each having an area of A/2) of the geothermal collector 1 is more than 0,5 and more than 0,55 times the cross-sectional area of the borehole, even if there is a distance d3 between the first and second portions 1',1", and small distances between the outer surfaces OS of the first and second portions 1',1" of the polymer geothermal collector 1, and the inner surface IS of the borehole, for enabling the installation of the geothermal collector 1 in the borehole. After installation however, the geothermal collector 1 is free to move in the borehole, causing the geothermal collector 1 to be placed in connection with the inner surface IS of the borehole at portions, which increases the heat transfer between the inner surface IS of the borehole and the geothermal collector 1.

Figure 9:
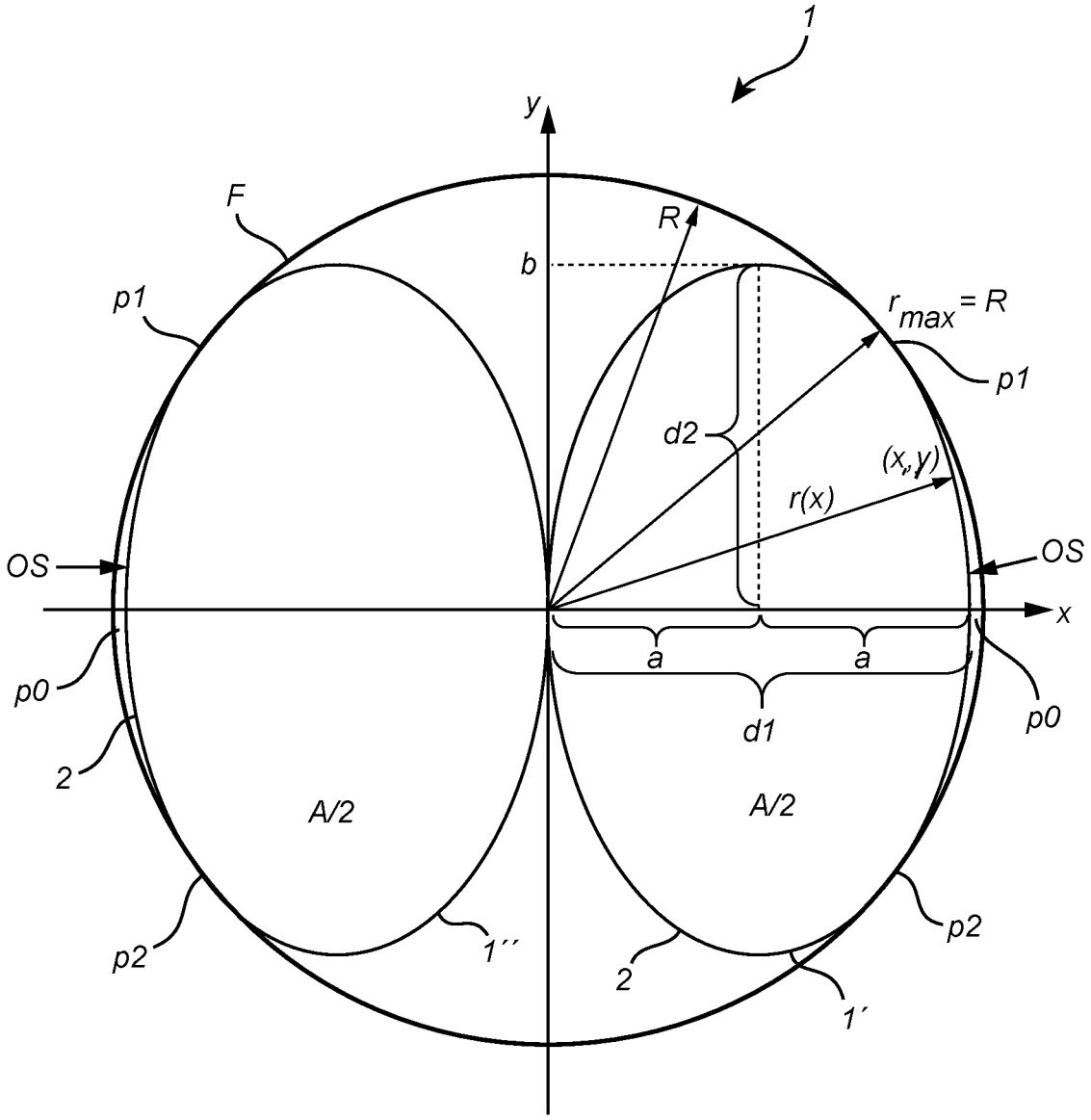
FIG. 9 shows a schematic, graph-like, cross-sectional view of a circular footprint as well as the elliptical cross-sections of the first and second portions of the polymer geothermal collector.

In the embodiment shown in FIG. 9, the non-circular cross-sections of the first and second portions 1',1" of the polymer geothermal collector 1 are elliptical.

FIG. 9 shows another embodiment of the polymer geothermal collector 1 comprising a first portion 1' for transporting the fluid into the well and a second portion 1" for transporting the fluid out from the well. In the embodiment of FIG. 9, the first and second portions 1',1" of the polymer geothermal collector 1 each have a non-circular cross-section, having a first cross-sectional distance d1 having a first length and a second cross-sectional distance d2 having a second length, in a plane perpendicular to the length extension of the polymer geothermal collector 1. In the embodiment shown in FIG. 9 the second length is more than 1,2 times the first length, and more than 1,3 times the first length, and more than 1,4 times the first length, and more than 1,5 times the first length, and more than 1,6 times the first length, and more than 1,7 times the first length, and in particular about 1,74 times the first length.

The wall 2 of each of the first and second portions 1',1" of the polymer geothermal collector 1 has a wall thickness t in the interval 0,02-0,06 times the sum of the first and second lengths, and in the interval 0,025-0,055 times the sum of the first and second lengths.

In the embodiment shown in FIG. 9, the outer surfaces OS of the non-circular cross-sections of the first and second portions 1',1" of the polymer geothermal collector 1 are be placed touching each other and simultaneously touching a circular footprint F. The combined cross-sectional area A (the area of each of the first and second portions 1',1" of the polymer geothermal collector being A/2) of the first and second portions 1',1" of the geothermal collector 1 is more than 0,6 times the area of the circular footprint F, and more than 0,7 times the area of the circular footprint F, and in particular about 0,77 times the area of the circular footprint F when the non-circular cross-sections of the first and second portions 1',1" of the polymer geothermal collector 1 are placed touching each other and simultaneously touching the circular footprint F.

In the embodiment shown in FIG. 9, the polymer geothermal collector 1 is configured to be used with a fluid for circulation in the geothermal collector having a density of above 1,1 g/cm3, and preferably above 1,15 g/cm3, and preferably above 1,2 g/cm3, for supporting the wall 2 of the first and second portions 1',1" of the polymer geothermal collector 1, when the polymer geothermal collector 1 has been installed in the well. The fluid for circulation in the geothermal collector preferably have a density in the interval 1,1-1,3 g/cm3. The fluid for circulation in the geothermal collector could for example be the fluid Kilfrost GEO, diluted with water in concentrations in the range 24%-60%, available from Kilfrost Limited, Albion Works, Haltwhistle, Northumberland NE49 OHJ, UK.

In the embodiment shown in FIG. 9, the outer surfaces OS of the non-circular cross-sections of the first and second portions 1',1" of the polymer geothermal collector 1 are each placed touching each other and simultaneously touching the circular footprint F in a first and second position p1,p2, interspaced by a position p0 in which each of the outer surfaces OS of the cross-sections of the first and second portions 1',1" of the polymer geothermal collector 1 does not touch the circular footprint F.

Having the outer surfaces OS of the first and second portions 1',1" being curved with a curvature having a radius exceeding the radius R of the circular footprint F, such that the first and second portions 1',1" touches each other and simultaneously touches the circular footprint F in a first and second position p1,p2, interspaced by a position p0 in which each of the outer surfaces OS of the cross-sections of the first and second portions 1',1" of the polymer geothermal collector 1 does not touch the circular footprint F, creates two points of contact (p1,p2) between each of the first and second portions 1',1" of the polymer geothermal collector 1 and the circular footprint F, and potentially between the first and second portions 1',1" of the polymer geothermal collector 1 and the inner surface of the borehole. Increasing the number of contact points between the polymer geothermal collector and the borehole increases the heat transfer between the borehole and the polymer geothermal collector 1, thus creating a more efficient system.

In the embodiment shown in FIG. 9, the non-circular cross-sections of the first and second portions 1',1" of the polymer geothermal collector 1 are elliptical.

To be able to transport as much fluid as possible in a borehole at a specific flowrate, the inner cross-sectional area of the of the first and second portions 1',1" of the polymer geothermal collector 1 should be made as large as possible. In the present invention, this means that two pipes having an as large cross-sectional area as possible should be used in the circular borehole. For the sake of mechanical properties and ease of manufacturing, an elliptically shaped cross-section is suitable. For the purpose of optimizing the shape of such elliptically shaped cross-sections the following steps should be taken.

FIG. 9 further shows an x-axis and a y-axis, with the circular foot print F centered around the origin, i.e. (x,y)=(0,0) in FIG. 9. The circular footprint F has a radius of R Inside the circular footprint F the first or second portion, 1', 1" are arranged, each having an elliptical cross-section, i.e. being an ellipsis. The ellipsis (1', 1") is centered around x=a, i.e. (x,y)=(a,0). For the purpose of optimizing the fluid flow, it is of interest to identify the biggest ellipsis which may fit inside one half of the circular footprint, and correspondingly the biggest two equally sized ellipses that would fit inside the circular footprint.

The ellipsis 1', 1" is defined by the below ellipses equation:

$$\left(\frac{x-a}{a}\right)^2+\left(\frac{y}{b}\right)^2=1$$

Thus, $y^2$ can be formulated as follows:

$$y^2=b^2\left(1-\frac{(x-a)^2}{a^2}\right)=\frac{b^2}{a^2}(a^2-x^2+2ax-a^2)=\frac{b^2}{a^2}(2ax-x^2)$$

Further, the length of the vector r can, with the help of Pythagoras' theorem and the above formulation of $y^2$, be formulated as:

$$r^2(x)=x^2+y^2=$$

$$x^2+\frac{b^2}{a^2}(2ax-x^2)=\frac{2b^2}{a}x-\left(\frac{b^2}{a^2}-1\right)x^2\rightarrow r(x)=\sqrt{\frac{2b^2}{a}x-\left(\frac{b^2}{a^2}-1\right)x^2}$$

The largest possible ellipsis that can fit inside the circle will tangent the circumference of the circle F. Further, the point where the ellipsis will tangent the circle is where the vector r is at a maximum. Thus, by deriving the function of r(x), and then setting r'(x)=0, the following is obtained:

$$r'(x)=\frac{1}{2}\left(\frac{2b^2}{a}x-\left(\frac{b^2}{a^2}-1\right)x^2\right)^{-\frac{1}{2}}\cdot\left(\frac{2b^2}{a}-2\left(\frac{b^2}{a^2}-1\right)x\right)$$

$$r'(x)=0\rightarrow\left(\frac{2b^2}{a}-2\left(\frac{b^2}{a^2}-1\right)x\right)=0\rightarrow x=\frac{b^2}{a\left(\frac{b^2}{a^2}-1\right)}$$

Thereby, a formula for x, which is dependent on a and b, which maximizes the length of the vector r is obtained. When the above formula for x is put into the equation for the vector r, the below is obtained for $r_{max}$. Further, as the maximally sized ellipsis tangents the circle F, $r_{max}$ is also equal to the radius R of the circle F:

$$r_{max}=\sqrt{\frac{2b^2}{a}\left(\frac{b^2}{a\left(\frac{b^2}{a^2}-1\right)}\right)-\left(\frac{b^2}{a^2}-1\right)\left(\frac{b^2}{a\left(\frac{b^2}{a^2}-1\right)}\right)^2}=$$

$$\sqrt{\frac{2b^4}{a^2\left(\frac{b^2}{a^2}-1\right)}-\frac{b^4}{a^2\left(\frac{b^2}{a^2}-1\right)}}=$$

$$\sqrt{\frac{b^4}{a^2\left(\frac{b^2}{a^2}-1\right)}}=\sqrt{\frac{b^4}{b^2\left(1-\frac{a}{b}\right)^2}}=b\sqrt{\frac{1}{1-\left(\frac{a}{b}\right)^2}}=R$$

Thus, a relationship between R, a and b is obtained, for the maximally sized ellipsis, which can be formulated accordingly:

$$R^2=\frac{b^2}{1-\left(\frac{a}{b}\right)^2}\rightarrow b^2-R^2\left(1-\left(\frac{a^2}{b^2}\right)\right)=$$

$$0\rightarrow b^4-R^2b^2+R^2a^2=0\rightarrow b^2=\frac{R^2}{2}\pm\sqrt{\left(\frac{R^2}{2}\right)^2-R^2a^2}=$$

$$\frac{R^2}{2}\pm\frac{R^2}{2}\sqrt{1-\frac{4}{R^4}R^2a^2}\rightarrow b=R\sqrt{\frac{1}{2}+\frac{1}{2}\sqrt{1-\left(\frac{2a}{R}\right)^2}}$$

The area A of the ellipsis is thereby:

$$A=ab\pi=R\pi a\sqrt{\frac{1}{2}+\frac{1}{2}\sqrt{1-\left(\frac{2a}{R}\right)^2}}=A(a)$$

By deriving the function A(a) (not shown here) and setting the value of A'(a)=0, the value of a that maximizes the area of the ellipsis is obtained. Once the value of a is obtained the corresponding value of b can be obtained. The resulting relationship between a, b and R for the maximally sized ellipsis is as follows; a=0.47 R and b=0.82 R. Thereby, the area of two such ellipses are equal to 0,77 of the area of the circular footprint F.

Figure 10A:
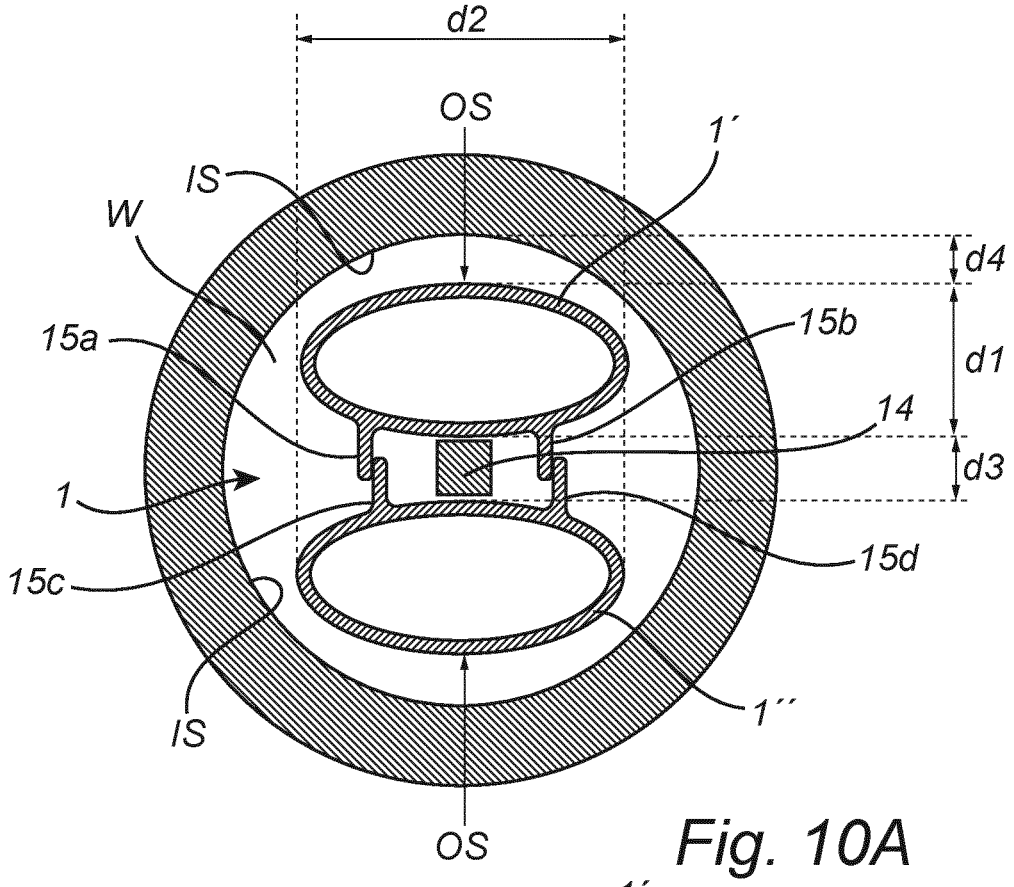
FIG. 10A shows a cross-sectional view of a well and a polymer geothermal collector placed in the well.

FIG. 10A shows a cross-sectional view of a polymer geothermal collector 1 for extracting geothermal energy from a well W. The polymer geothermal collector 1 is configured to be placed in the well W for enabling circulation of a fluid in the polymer geothermal collector 1, when placed in the well W. The polymer geothermal collector 1 performs heat exchange between the fluid in the polymer geothermal collector 1 and the well W by means of the circulating fluid. The geothermal collector 1 comprises a first portion 1' for transporting the fluid into the well W and a second portion 1" for transporting the fluid out from the well W.

Figure 10B:
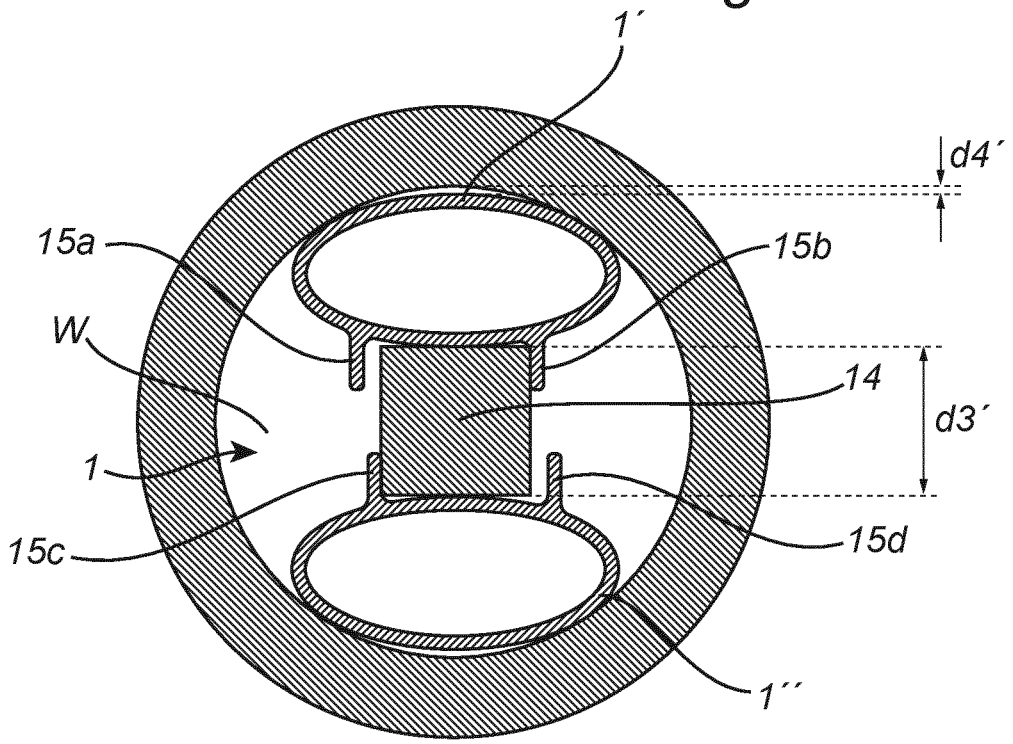
FIG. 10B shows a cross-sectional view of a well and a polymer geothermal collector placed in the well, when a hydrophilic swelling material has been expanded.

The first and second portions 1',1" of the polymer geothermal collector 1 each have a curved outer surface OS configured to face an inner surface IS of the well W, and in the embodiment shown in FIGS. 10A and 10B, the curvature of the curved outer surface OS substantially matches the curvature of the inner surface IS of the well W.

The polymer geothermal collector 1 further comprises a hydrophilic swelling material 14 disposed between the first and second portions 1',1" of the polymer geothermal collector 1. The hydrophilic swelling material 14 is configured to expand when exposed to water and to engage and exert force against the first and second portions 1',1" of the polymer geothermal collector 1, from a position between the first and second portions 1',1", to increase a distance d3 between the first and second portions 1',1" of the polymer geothermal collector 1 to thereby decrease a distance d4 between at least one of the curved outer surfaces OS and the inner surface IS of the well W for increasing the contact and thereby the heat transfer between the curved outer surfaces OS and the inner surface IS of the well W.

In the embodiment shown in FIGS. 10A and 10B, the hydrophilic swelling material 14 is a hydrophilic thermoplastic elastomer (TPE) having an expanded volume (shown in FIG. 10B) exceeding two times a non-expanded volume (shown in FIG. 10A). Hydrophilic TPE contains small spherical polymer particles that are called Nano Particulate Hydrophilic Polymers. Each particle expands in a controlled and integrated way to produce the swelling.

In the embodiment shown in FIGS. 10A and 10B the first and second portions 1',1" of the polymer geothermal collector 1 each have a non-circular cross-section. The non-circular cross-section has a first cross-sectional distance d1 having a first length and a second cross-sectional distance d2 having a second length, in the plane in which the cross-section in FIGS. 10A and 10B is depicted being perpendicular to the length extension of the polymer geothermal collector 1. In the embodiment shown in FIG. 10A and 10B, the second length d2 is more than 1,2 times the first length d1, more specifically, more than 1,3 times the first length d1, more specifically, more than 1,4 times the first length d1, and in the embodiment shown in FIGS. 10A and 10B, the non-circular cross-sections of the first and second portions 1',1" of the polymer geothermal collector 1 are elliptical. In the embodiment shown in FIGS. 10A and 10B, the wall of each of the first and second portions 1',1" of the polymer geothermal collector 1 has a wall thickness in the interval 0,02-0,06 times the sum of the first and second lengths d1, d2, and in the interval 0,025-0,055 times the sum of the first and second lengths d1, d2. As the cross-sections of the first and second portions 1',1" of the polymer geothermal collector 1 are elliptical, the first and second portions 1',1" also comprises a curved inner surface facing the hydrophilic swelling material 14, such that the force exerted by the expansion of the hydrophilic swelling material 14 is exerted on a curved surface which is less prone to deformation.

One advantage with the use of a hydrophilic swelling material 14 is that the hydrophilic swelling material 14 adapted to the shape, such that the swelling is unrelated to the form of the pipes, which allows for shapes maximizing the strength and cross-sectional area (such as further elaborated on with reference to FIGS. 8 and 9).

In the embodiment shown in FIGS. 10A and 10B, the cross-sections of the first and second portions 1',1" are uniform, i.e., in the cross-section depicted in FIGS. 10A and 10B, the shape, circumference and cross-sectional areas of the cross-sections of the first and second portions 1',1" are identical.

The first and second portions 1',1" of the polymer geothermal collector 1 shown in FIGS. 10A and 10B comprises protruding support element (15*a*-15*d*) for assisting in directing the force exerted by the hydrophilic swelling material 14 as it expands. Two protruding support elements 15*a*, 15*b* of the first portion 1' of the polymer geothermal collector 1 protrudes towards the two protruding support elements 15*c*, 15*d* of the second portion 1" of the polymer geothermal collector 1, such that the hydrophilic swelling material 14 is confined by the protruding support elements 15*a*-15*d* of the first and second portions 1',1" of the polymer geothermal collector 1.

In the embodiment shown in FIGS. 10A and 10B, the two protruding support elements 15*a*, 15*b* of the first portion 1' of the polymer geothermal collector 1 are parallel with each other and with the two protruding support elements 15*c*, 15*d* of the second portion 1" of the polymer geothermal collector 1, such that a substantially rectangular footprint is created between the protruding support elements 15*a*-15*d*.

In the embodiment shown in FIGS. 10A and 10B, each of the protruding support elements 15*a*-15*d* protrudes a length from the curved outer surfaces OS of the first and second portions 1',1", respectively, exceeding the wall thickness of the wall first and second portions 1',1" of the polymer geothermal collector 1.

FIG. 10B shows the embodiment shown in FIG. 10A in the state in which the hydrophilic swelling material 14 has expanded to a volume exceeding two times the volume of the hydrophilic swelling material 14 in its non-expanded state, more specifically to more than four times the volume of the hydrophilic swelling material 14 in its non-expanded state, more specifically to more than six times the volume of the hydrophilic swelling material 14 in its non-expanded state. The hydrophilic swelling material 14 has pushed the first and second portions 1',1" apart, such that the distance between the first and second portions 1',1" has been increased to d3', which thereby has decreased the distance between the curved outer surfaces OS and the inner surface IS of the well W to a distance d4', which has increased the contact and thereby the heat transfer between the curved outer surface OS and the inner surface IS of the well W.

In the embodiment shown in FIGS. 10A and 10B, the distance between the first and second portions 1',1" has increased more than 1,2 times from d3 to d3', more specifically more than 1,5 times from d3 to d3', and even more specifically more than 2 times from d3 to d3'.

In the embodiment shown in FIGS. 10A and 10B, the distance between the outer surfaces OS of the first and second portions 1',1" and the inner surface IS of the well W has decreased to less than 0,8 times from d4 to d4', more specifically to less than 0,6 times from d4 to d4', and even more specifically to less than 0,4 times from d4 to d4'. I.e. the distance d4' is less than 0,4 times the distance d4.

In the embodiments shown in FIGS. 10A and 10B, the hydrophilic swelling material 14 is loosely placed between the first and second portions 1',1" of the polymer geothermal collector 1. When the first and second portions 1',1" of the polymer geothermal collector 1 is fed into the well W, the hydrophilic swelling material 14 is simultaneously fed in between the first and second portions 1',1". In the embodiments shown in FIGS. 10A and 10B, the hydrophilic swelling material 14 has a cross sectional distance, in a direction from a cross-sectional center of the first portion 1' to a cross-sectional center of the second portion 1", exceeding 1 mm, or preferably exceeding 2 mm, or preferably exceeding 3 mm, or preferably exceeding 5 mm.

The method of installing the polymer geothermal collector 1 in the well W including the feeding of the first and second portions 1',1" of the polymer geothermal collector 1 into the well W is preferably performed using a collector feeder which is a motorized feeding machine comprising at least one pulley configured to engage and feed the first portion 1' and at least one second pulley configured to engage and feed the second portion 1" simultaneously. When feeding the polymer geothermal collector 1 according to the embodiments shown in FIG. 10A and 10B, the collector feeder further comprises a feeder for the hydrophilic swelling material 14, such that the hydrophilic swelling material 14 can be disposed between the first and second portions 1', 1". The feeding of the first portion 1', second portion 1" and hydrophilic swelling material 14 is preferably performed simultaneously.

In alternative embodiments, the hydrophilic swelling material 14 may be fixated to at least one of the first and second portions 1',1" of the polymer geothermal collector 1, such that the hydrophilic swelling material 14 is fed together with the first or second portion 1',1". In one embodiment, the hydrophilic swelling material is fixated both to the first and second portions of the polymer geothermal collector, such that the first and second portions of the polymer geothermal collector are fixated to each other by their respective fixations to the hydrophilic swelling material. It is also conceivable that the first and second portions 1',1" of the polymer geothermal collector 1 and the hydrophilic swelling material 14, are bundled together using a dissolvable wrapping which dissolves by means of the water in the well and/or by means of the pressure exerted by the hydrophilic swelling material 14.

The polymer geothermal collector 1 of the embodiments shown in FIGS. 10A and 10B has a total length of more than 800 m, such that the polymer geothermal collector 1 is adapted for a well having a depth of more than 400 m. I.e., the first portion 1' has a length exceeding 400 m and the second portion 1" has a length exceeding 400 m. In alternative embodiments, the polymer geothermal collector 1 has a total length of more than 1000 m, such that the polymer geothermal collector 1 is adapted for a well having a depth of more than 500 m. One advantage with using the hydrophilic swelling material 14 is that it may not be necessary to fill the well W with bentonite to increase the thermal conductivity between the surface of the bore hole and the outer surface of the collector, as the collector is pressed against the inner surface of the bore hole creating a direct connection. Filling a well with bentonite may be difficult for deep bore holes (such as bore holes exceeding 300 m) and the use of the hydrophilic swelling material 14 may therefore be particularly suitable for such deep bore holes. However, the hydrophilic swelling material 14 is beneficial for use also in less deep bore holes, such as bore holes ranging from 100 m-300 m.

A further advantage with the use of a hydrophilic thermoplastic elastomer (TPE) is that the swelling takes relatively long time, which means that it is possible to establish that the pipe is properly installed before the swelling takes off. A typical TPE expands to about two times its initial volume in 6 hours, and to about 4 times its initial volume after 24 hours.

The polymer geothermal collector 1 of FIGS. 10A and 10B may have an internal helical pattern built up from protrusions and grooves for increasing the turbulence of the fluid flowing in the collector 1. The protrusions and the grooves may vary as described in relation to FIGS. 3D and 3E, both in terms of height, numbers, distribution and rotation ratio.

Figure 11A:
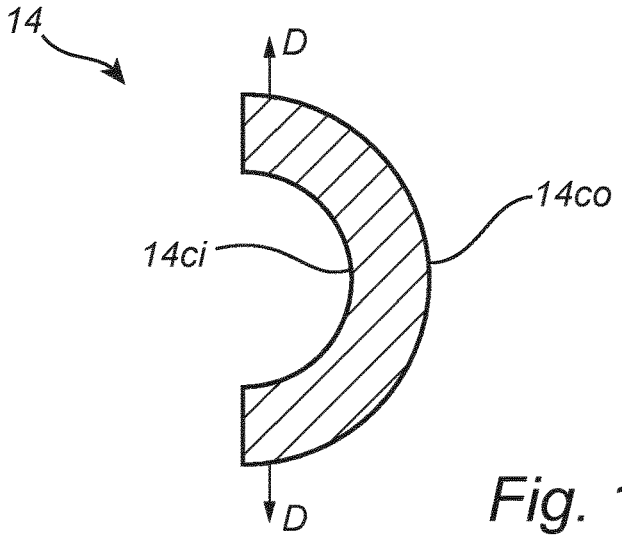
FIG. 11A shows a cross-sectional view of a hydrophilic swelling material.

FIG. 11A shows a cross-sectional view if the hydrophilic swelling material 14 when the hydrophilic swelling material 14 has a semi-circular shape having a concave inner curved surface 14*ci* and an outer convex curved surface 14*co*. The semi-circular shape focuses the expansion in the directions D towards the first and second portions (1', 1" as shown in FIGS. 10A and 10B), as the semi-circular shape "unfolds" as the hydrophilic swelling material 14 expands which leads to an increase of the radii of the inner and outer curved surfaces 14*ci*, 14*co* which focuses the expanding force towards the directions D.

Figure 11B:
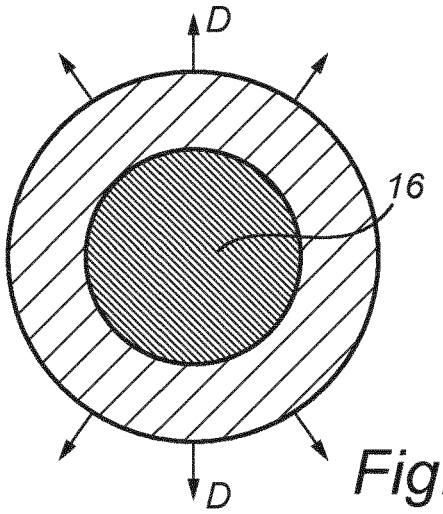
FIG. 11B shows a cross-sectional view of a hydrophilic swelling material enclosing a non-expanding core.

FIG. 11B shows a cross-sectional view if the hydrophilic swelling material 14 in an embodiment in which the hydrophilic swelling material 14 encloses a non-expanding core 16 which focuses the expansion in a direction away from the non-expanding core 16 and thus towards the desired directions D for exerting force for separating the first and second portions (1', 1" as shown in FIGS. 10A and 10B). In the embodiment shown in fog. 11B, the hydrophilic swelling material 14 has a circular cross-section.

Figure 11C:
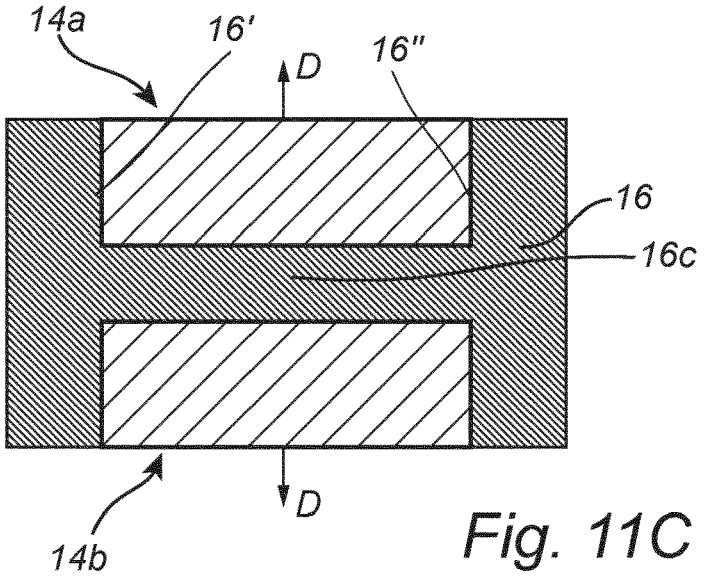
FIG. 11C shows a cross-sectional view of a hydrophilic swelling material partially enclosed by a non-expanding material.

FIG. 11B shows a cross-sectional view if the hydrophilic swelling material 14 in an embodiment in which the hydrophilic swelling material 14 is partially enclosed by a non-expanding material 16, confining the hydrophilic swelling material 14 to expansion substantially in the direction D. In the embodiment shown in FIG. 11C, the non-expanding material 16 has an H-shaped cross-section, with two parallel inner surfaces 16', 16" engaging the hydrophilic swelling material 14 and restricting expansion in a direction perpendicularly to the desired direction D. As such, the H-shaped non-expanding material 16 replaces the function of the protruding support elements (15*a*-15*d* in FIGS. 10A and 10B). In the embodiment shown in FIG. 11C, the hydrophilic swelling material 14 is divided into a first and second portion 14*a*, 14*b* by a central portion 16*c* of the non-expanding material 16. This central portion 16*c* connects the two parallel surfaces 16', 16" and provides the counter force needed to confine the hydrophilic swelling material 14, such that the hydrophilic swelling material 14 is hindered from expanding in a direction perpendicularly to the desired direction D.

Please note that the detailed description should be interpreted in its broadest outline and that any embodiment or part of embodiment could be combined in any way. All examples herein should be seen as part of the general description and therefore possible to combine in any way in general terms.

In the following, numbered aspect groups A and B of the present invention are provided. The different aspects are numbered individually within the groups and the references to other aspects relate to aspects within the same group. The scope of protection is however defined by the appended claims.

Aspect A

1A. A geothermal pipe collector (1) for transporting a fluid for heat exchange with the ground surrounding a borehole, the geothermal pipe collector (1) comprising:

an outer pipe (120) comprising a fiber reinforced thermoset polymer material, and an inner pipe (110) being made from a material comprising a second polymer material, different from the fiber reinforced thermoset polymer material, wherein:

the inner pipe (110) is co-axially arranged in the outer pipe (120), such that a central longitudinal lumen (105) for transporting the fluid in a first direction is formed in the inner pipe (110), and an intermediate longitudinal lumen (115) for transporting the fluid in a second direction is formed between the inner and outer pipes (110,120), the average wall thickness (T1) of the inner pipe (110) is more than 1,1, times the average wall thickness (T2) of the outer pipe (120), and the outer pipe (120) is adapted to exchange heat with the ground surrounding the borehole, when in use.

2A. The geothermal pipe collector (1) according to aspect 1A, wherein the fiber reinforced thermoset polymer material comprises at least one of an epoxy material or a polyester resin.

3A. The geothermal pipe collector (1) according to any one of aspects 1A-2A, wherein the fiber reinforced thermoset polymer material comprises at least one of glass fibers and carbon fibers.

4A. The geothermal pipe collector (1) according to any one of aspects 1A-3A, wherein the second polymer material is more elastic than the fiber reinforced thermoset polymer material.

5A. The geothermal pipe collector (1) according to any one of aspects 1A-4A, wherein the second polymer material comprises at least one of a PVC-based material, a natural rubber-based material, and a synthetic rubber-based material.

6A. The geothermal pipe collector (1) according to any one of aspects 1A-5A, wherein the outer pipe (120) has lower thermal resistance than the inner pipe (110).

7A. The geothermal pipe collector (1) according to any one of aspects 1A-6A wherein the material of the inner pipe (110) comprises more gas measured in volume percentage than the material of the outer pipe (120).

8A. The geothermal pipe collector (1) according to any one of aspects 1A-7A, wherein the material of the inner pipe comprises a plurality of volumes of gas enclosed by an enclosing material, which in turn is enclosed by the second polymer material, for increasing the thermal resistance of the second polymer material, and wherein the enclosing material is harder than the second polymer material.

9A. The geothermal pipe collector (100) according to any one of aspects 8A and 9A, wherein the plurality of volumes of gas enclosed by an enclosing material makes up at least 3 volume percent of the material of the inner pipe, more preferably at least 5 volume percent of the material of the inner pipe, and even more preferably at least 10 volume percent of the material of the inner pipe.

10A. The geothermal pipe collector (100) according to any of the preceding aspects, wherein the inner pipe (110) has a helical groove (122) on the outer surface, facing the outer pipe (120), for creating a turbulent flow of the fluid between the inner and outer pipes, for increasing the heat exchange between the fluid and the outer pipe (120).

11A. The geothermal pipe collector (100) according to any of the preceding aspects, wherein the central longitudinal lumen (105) has a cross-sectional area in a plane perpendicular to the length extension of the geothermal pipe collector (100) being larger than a cross-sectional area of the intermediate longitudinal lumen (115) in the same plane.

12A. The geothermal pipe collector (100) according to aspect 11A, wherein the wherein the central longitudinal lumen (105) has a cross-sectional area in a plane perpendicular to the length extension of the geothermal pipe collector (100) being more than 1,1 times the size of the cross-sectional area of the intermediate longitudinal lumen (115) in the same plane.

13A. A geothermal pipe collector system comprising:

the geothermal pipe collector according to any one of aspects 1A-12A, and the fluid for circulation in the geothermal pipe collector, wherein the fluid has a relative density of above 1,10 for supporting the wall of the outer pipe of the polymer geothermal collector (100), when the polymer geothermal collector (100) has been installed in the well.

14A. Use of a plurality of geothermal pipe collectors (100, 200A, 200B) according to any one of aspects 1A-12A for forming an assembled coaxial geothermal pipe collector for transporting the fluid, wherein the assembled coaxial geothermal pipe collector has a total length of more than 200 meters, preferably more than 300 meters, preferably more than 400 meters, preferably more than 600 meters, preferably more than 800 meters.

15A. A method of installing a coaxial geothermal pipe collector comprising a plurality of outer pipes (120', 120") according to any one of aspects 1A-12A and a plurality of inner pipes (110) according to any one of aspects 1A-12A, the method comprising:

providing a first outer pipe (120') into a bore hole, bringing a second outer pipe (120") in abutment with the first outer pipe (120'), rotating the second outer pipe (120") relative the first outer pipe (120'), so as to couple said first outer pipe (120') to said second outer pipe (120") by means of two matching threads, providing an inner pipe (110) into the outer pipe (120) placed in the bore hole, providing a second inner pipe (110) in abutment with the first inner pipe (110) into the outer pipe (120) placed in the bore hole, and connecting the second inner pipe (110) to the first inner pipe (110) for forming the coaxial collector.

Aspect B

1B. A system for extracting geothermal energy from a well, the system comprises a polymer geothermal collector (1) configured to be placed in the well for enabling circulation of a fluid in the polymer geothermal collector (1), when placed in the well, for performing heat exchange between the fluid in the polymer geothermal collector (1) and the well, the polymer geothermal collector (1) comprising a first portion (1') for transporting the fluid into the well and a second portion (1") for transporting the fluid out from the well, wherein:

the first and second portions (1',1") of the polymer geothermal collector (1) each have a non-circular cross-section, having a first cross-sectional distance (d1) having a first length and a second cross-sectional distance (d2) having a second length, in a plane perpendicular to the length extension of the polymer geothermal collector (1), and wherein the second length is at least 1,2 times the first length, a wall (2) of each of the first and second portions (1',1") of the polymer geothermal collector (1) has a wall thickness (t) in the interval 0,02-0,06 times the sum of the first and second lengths, and wherein outer surfaces (OS) of the non-circular cross-sections of the first and second portions (1',1") of the polymer geothermal collector (1) can be placed touching each other and simultaneously touching a circular footprint (F), and wherein the combined cross-sectional area (A) of the first and second portions (1',1") of the geothermal collector (1) is at least 0,6 times the area of the circular footprint (F), when the non-circular cross-sections of the first and second portions (1',1") of the polymer geothermal collector (1) are placed touching each other and simultaneously touching the circular footprint (F), and wherein the system further comprises the fluid for circulation in the geothermal collector (1), wherein the fluid has a density of above 1,1 g/cm3 for supporting the wall (2) of the first and second portions (1',1") of the polymer geothermal collector (1), when the polymer geothermal collector (1) has been installed in the well.

2B. The system according to aspect 1B, wherein the second length is at least 1,3 times the first length or at least 1,4 times the first length.

3B. The system according to any one of aspects 1B and 2B, wherein the wall (2) of each of the first and second portions (1',1") of the polymer geothermal collector (1) has a wall thickness (t) in the interval 0,025-0,055 times the sum of the first and second lengths.

4B. The system according to any one of aspects 1B-3B, wherein the combined cross-sectional area (A) of the first and second portions (1',1") of the polymer geothermal collector (1) is at least 0,7 times the area of the circular footprint (F).

5B. The system according to any one of aspects 1B-4B, wherein the fluid has a density of above 1,15 g/cm3 for supporting the wall (2) of the first and second portions (1',1") of the polymer geothermal collector (1) when the polymer geothermal collector (1) has been installed in the well.

6B. The system according to any one of aspects 1B-5B, wherein the first cross-sectional distance (d1) has a length being in the interval 0,9-1 times the length of the radius (R) of the circular footprint (F).

7B. The system according to any one of aspects 1B-6B, wherein the outer surfaces (OS) of the non-circular cross-sections of the first and second portions (1',1") of the polymer geothermal collector (1), each can be placed touching each other and simultaneously touching the circular footprint (F) in a first and second position (p1,p2), interspaced by a position (p0) in which each of the outer surfaces (OS) of the cross-sections of the first and second portion (1',1") of the polymer geothermal collector (1) does not touch the circular footprint (F).

8B. The system according to any one of aspects 1B-7B, wherein the non-circular cross-sections of the first and second portions (1',1") of the polymer geothermal collector (1) are elliptical.

9B. A polymer geothermal collector (1) for extracting geothermal energy from a well, the polymer geothermal collector (1) being configured to be placed in the well for enabling circulation of a fluid in the polymer geothermal collector (1), when placed in the well, for performing heat exchange between the fluid in the polymer geothermal collector (1) and the well, the geothermal collector (1) comprising a first portion (1') for transporting the fluid into the well and a second portion (1") for transporting the fluid out from the well, wherein:

the polymer geothermal collector (1) has a total length of more than 800 m, such that the polymer geothermal collector (1) is adapted for a well having a depth of more than 400 m, the first and second portions (1',1") of the polymer geothermal collector (1) each have a non-circular cross-section, having a first cross-sectional distance (d1) having a first length and a second cross-sectional distance (d2) having a second length, in a plane perpendicular to the length extension of the polymer geothermal collector (1), and wherein the second length is at least 1,2 times the first length, a wall (2) of each of the first and second portions (1',1") of the polymer geothermal collector (1) has a wall thickness (t) in the interval 0,02-0,06 times the sum of the first and second lengths, and being configured to be supported by the fluid for circulation in the polymer geothermal collector (1), wherein the fluid has a density above 1,1 g/cm3 for supporting the wall (2) of the first and second portions (1',1") of the polymer geothermal collector (1), when the polymer geothermal collector (1) has been installed in the well, and wherein outer surfaces (OS) of the non-circular cross-sections of the first and second portions (1',1") of the polymer geothermal collector (1) can be placed touching each other and simultaneously touching a circular footprint (F), and wherein the combined cross-sectional area (A) of the first and second portions (1',1") of the geothermal collector (1) is at least 0,6 times the area of the circular footprint (F), when the non-circular cross-sections of the first and second portions (1',1") of the polymer geothermal collector (1) are placed touching each other and simultaneously touching the circular footprint (F).

10B. The polymer geothermal collector (1) according to aspect 9B, wherein the second length is at least 1,3 times the first length or at least 1,4 times the first length.

11B. The polymer geothermal collector (1) according to any one of aspects 9B-10B, wherein the wall (2) of each of the first and second portions (1',1") of the polymer geothermal collector (1) has a wall thickness (t) in the interval 0,025-0,055 times the sum of the first and second lengths.

12B. The polymer geothermal collector (1) according to any one of aspects 9B-11B, wherein the combined cross-sectional area (A) of the first and second portions (1',1") of the polymer geothermal collector (1) is at least 0,7 times the area of the circular footprint (F).

13B. The polymer geothermal collector (1) according to any one of aspects 9B-12B, wherein the outer surfaces (OS) of the non-circular cross-sections of the first and second portions (1',1") of the polymer geothermal collector (1) each can be placed touching each other and simultaneously touching the circular footprint (F) in a first and second position (p1,p2), interspaced by a position (p0) in which each of the outer surfaces (OS) of the cross-sections of the first and second portion (1',1") of the polymer geothermal collector (1) does not touch the circular footprint (F).

14B. The polymer geothermal collector (1) according to any one of aspects 9B-13B, wherein the first cross-sectional distance (d1) has a length being in the interval 0,9-1 times the length of the radius (R) of the circular footprint (F).

15B. The polymer geothermal collector (1) according to any one of aspects 9B-14B, wherein the polymer geothermal collector (1) has a total length of more than 1000 m, such that the polymer geothermal collector (1) is adapted for a well having a depth of more than 500 m.

What is claimed is:

1. A system for extracting geothermal energy from a well, the system comprising a polymer geothermal collector configured to be placed in the well for enabling circulation of a fluid in the polymer geothermal collector, when placed in the well, for performing heat exchange between the fluid in the polymer geothermal collector and the well, the polymer geothermal collector comprising a first portion for transporting the fluid into the well and a second portion for transporting the fluid out from the well, wherein:

the first and second portions of the polymer geothermal collector each have a non-circular cross-section, having a first cross-sectional distance having a first length and a second cross-sectional distance having a second length, in a plane perpendicular to the length extension of the polymer geothermal collector, and wherein the second length is at least 1.2 times the first length, a wall of each of the first and second portions of the polymer geothermal collector has a wall thickness in an interval 0.02-0.06 times a sum of the first and second lengths, outer surfaces of the non-circular cross-sections of the first and second portions of the polymer geothermal collector can be placed touching each other and simultaneously touching a circular footprint, a combined cross-sectional area of the first and second portions of the polymer geothermal collector is at least 0.6 times an area of the circular footprint, when the non-circular cross-sections of the first and second portions of the polymer geothermal collector are placed touching each other and simultaneously touching the circular footprint, and the system further comprising the fluid for circulation in the polymer geothermal collector, the fluid having a density of above 1.1 g/cm3 for supporting the walls of the first and second portions of the polymer geothermal collector, when the polymer geothermal collector has been installed in the well.

2. The system according to claim 1, wherein the second length is at least 1.3 times the first length.

3. The system according to claim 2, wherein the second length is at least 1.4 times the first length.

4. The system according to claim 1, wherein the wall of each of the first and second portions of the polymer geothermal collector has a wall thickness in the interval 0.025-0.055 times the sum of the first and second lengths.

5. The system according to claim 1, wherein the combined cross-sectional area of the first and second portions of the polymer geothermal collector is at least 0.7 times the area of the circular footprint.

6. The system according to claim 1, wherein the fluid has a density of above 1.15 g/cm3 for supporting the walls of the first and second portions of the polymer geothermal collector when the polymer geothermal collector has been installed in the well.

7. The system according to claim 1, wherein the first cross-sectional distance has a length being in the interval 0.9-1 times a length of a radius of the circular footprint.

8. The system according to claim 1, wherein the outer surfaces of the non-circular cross-sections of the first and second portions of the polymer geothermal collector each can be placed touching each other and simultaneously touching the circular footprint in a first and second position, interspaced by a position in which each of the outer surfaces of the cross-sections of the first and second portion of the polymer geothermal collector does not touch the circular footprint.

9. The system according to claim 1, wherein the non-circular cross-sections of the first and second portions of the polymer geothermal collector are elliptical.

10. A polymer geothermal collector for extracting geothermal energy from a well, the polymer geothermal collector being configured to be placed in the well for enabling circulation of a fluid in the polymer geothermal collector, when placed in the well, for performing heat exchange between the fluid in the polymer geothermal collector and the well, the polymer geothermal collector comprising a first portion for transporting the fluid into the well and a second portion for transporting the fluid out from the well, wherein:

the first and second portions of the polymer geothermal collector each have an elliptical cross-section, having a first cross-sectional distance having a first length and a second cross-sectional distance having a second length, in a plane perpendicular to a length extension of the polymer geothermal collector, and wherein the second length is at least 1.2 times the first length, a wall of each of the first and second portions of the polymer geothermal collector has a wall thickness in the interval 0.02-0.06 times a sum of the first and second lengths, and is configured to be supported by the fluid for circulation in the polymer geothermal collector, wherein the fluid has a density above 1.1 g/cm3 for supporting the walls of the first and second portions of the polymer geothermal collector, when the polymer geothermal collector has been installed in the well, outer surfaces of the elliptical cross-sections of the first and second portions of the polymer geothermal collector can be placed touching each other and simultaneously touching a circular footprint, and a combined cross-sectional area of the first and second portions of the polymer geothermal collector is at least 0.6 times an area of the circular footprint, when the elliptical cross-sections of the first and second portions of the polymer geothermal collector are placed touching each other and simultaneously touching the circular footprint.

11. The polymer geothermal collector according to claim 10, wherein the second length is at least 1.3 times the first length.

12. The polymer geothermal collector according to claim 11, wherein the second length is at least 1.4 times the first length.

13. The polymer geothermal collector according to claim 10, wherein the wall of each of the first and second portions of the polymer geothermal collector has a wall thickness in the interval 0.025-0.055 times the sum of the first and second lengths.

14. The polymer geothermal collector according to claim 10, wherein the combined cross-sectional area of the first and second portions of the polymer geothermal collector is at least 0.7 times the area of the circular footprint.

15. The polymer geothermal collector according to claim 10, wherein the outer surfaces of the elliptical cross-sections of the first and second portions of the polymer geothermal collector each can be placed touching each other and simultaneously touching the circular footprint in a first and second position, interspaced by a position in which each of the outer surfaces of the cross-sections of the first and second portion of the polymer geothermal collector does not touch the circular footprint.

16. The polymer geothermal collector according to claim 10, wherein the first cross-sectional distance has a length being in the interval 0.9-1 times the length of a radius of the circular footprint.

17. The polymer geothermal collector according to claim 10, wherein the polymer geothermal collector has a total length of more than 800m, such that the polymer geothermal collector is adapted for a well having a depth of more than 400m.

18. The polymer geothermal collector according to claim 17, wherein the polymer geothermal collector has a total length of more than 1000m, such that the polymer geothermal collector is adapted for a well having a depth of more than 500m.

* * * * *